US005188917A

United States Patent [19]

Kato

[11] Patent Number: 5,188,917

[45] Date of Patent: Feb. 23, 1993

[54] ELECTROPHOTOGRAPHIC LIGHT-SENSITIVE MATERIAL

[75] Inventor: Eiichi Kato, Shizuoka, Japan

[73] Assignee: Fuji Photo Film Co., Ltd., Kanagawa, Japan

[21] Appl. No.: 704,743

[22] Filed: May 23, 1991

[30] Foreign Application Priority Data

May 25, 1990 [JP] Japan ..... 2-133962

[51] Int. Cl.[5] ..... G03G 5/08

[52] U.S. Cl. ..... 430/96; 430/49; 430/83

[58] Field of Search ..... 430/96, 83, 49

[56] References Cited

U.S. PATENT DOCUMENTS

| | | | |
|---|---|---|---|
| 3,870,516 | 3/1975 | Smith et al. | 96/1.5 |
| 3,909,261 | 9/1975 | Jones | 96/1.5 |
| 4,954,407 | 9/1990 | Kato et al. | 430/96 |
| 5,009,975 | 4/1991 | Kato et al. | 430/96 |
| 5,030,534 | 7/1991 | Kato et al. | 430/96 |

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

An electrophotographic light-sensitive material comprising a support having provided thereon a photoconductive layer containing at least an inorganic photoconductive substance and a binder resin, wherein the binder resin comprises (1) at least one AB block copolymer (Resin (A)) having a weight average molecular weight of from $1\times10^3$ to $2\times10^4$ and composed of an A block comprising at least one polymerizable component containing at least one acidic group selected from $-PO_3H_2$, $-COOH$, $-SO_3H$, a phenolic hydroxy group, (wherein R represents a hydrocarbon group or —OR' (wherein R' represents a hydrocarbon group)) and a cyclic acid anhydride-containing group, and a B block containing at least a polymerizable component represented by the following general formula (I):

(I)

wherein $R_1$ represents a hydrocarbon group; and (2) at least one resin (Resin (B)) having a weight average molecular weight of $5\times10^4$ or more, containing a repeating unit represented by the general formula (III) described below as a copolymerizable component, and having a crosslinked structure made before the preparation of a dispersion for forming the photoconductive layer:

(III)

wherein $T_2$ represents —COO—, —OCO—, $-CH_2OCO-$, $-CH_2COO-$, —O—, or $-SO_2-$; $R_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, $-COOZ_4$, or $-COOZ_4$ bonded through a hydrocarbon group having from 1 to 8 carbon atoms, wherein $Z_4$ represents a hydrocarbon group having from 1 to 18 carbon atoms.

13 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics and moisture resistance.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if desired, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing on the order of from several hundreds to several thousands prints having a high image quality.

Binders which are used for forming the photoconductive layer of an electrophotographic light-sensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to prior light-exposure and also have an excellent image forming properties, and the photoconductive layer stably maintains these electrostatic properties in spite of the change of humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention characteristic and photosensitivity, and smoothness of the photoconductive layer.

In order to overcome the above problems, JP-A-63-217354, JP-A-1-70761 and JP-A-2-67563 (the term "JP-A" as used herein means an "unexamined Japanese patent application") disclose improvements in the smoothness of the photoconductive layer and electrostatic characteristics by using, as a binder resin, a resin having a low molecular weight and containing from 0.05 to 10% by weight of a copolymerizable component containing an acidic group in a side chain of the polymer, or a resin having a low molecular weight (i.e., a weight average molecular weight (Mw) of from $1\times10^3$ to $1\times10^4$) and having an acidic group bonded at the terminal of the polymer main chain thereby obtaining an image having no background stains. Also, JP-A-1-100554 and JP-A-1 -214865 disclose a technique using, as a binder resin, a resin containing a polymerizable component containing an acidic group in a side chain of the copolymer or at the terminal of the polymer main chain and a polymerizable component having a heat- and/or photo-curable functional group; JP-A-1-102573 and JP-A-2-874 disclose a technique using a resin containing an acidic group in a side chain of the copolymer or at the terminal of the polymer main chain, and a crosslinking agent in combination; JP-A-64-564, JP-A-63-220149, JP-A-63-220148, JP-A-1-280761, JP-A-1-116643 and JP-A-1-169455 disclose a technique using the above-described resin having a low molecular weight (a weight average molecular weight of from $1\times10^3$ to $1\times10^4$) and a resin having a high molecular weight (a weight average molecular weight of $1\times10^4$ or more) in combination; JP-A-1-211766 and JP-A-2-34859 disclose a technique using the above described low molecular weight resin and a heat- and/or photo-curable resin in combination; JP-A-2-53064, JP-A-2-56558 and JP-A-2-103056 disclose a technique using the above described low molecular weight resin and a comb-like polymer in combination; and JP-A-2-34860, JP-A-2-40660 and JP-A-2-96766 disclose a technique using the above-described low molecular resin and a resin previously crosslinked in combination. These references disclose that, according to the proposed technique, the film strength of the photoconductive layer can be increased sufficiently and also the mechanical strength of the light-sensitive material can be increased without adversely affecting the above-described electrostatic characteristics owing to the use of a resin containing an acidic group in a side chain of the copolymer or at the terminal of the polymer main chain.

However, it has been found that, even in the case of using these resins, it is yet insufficient to keep the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing plate precursors, various problems may occur in that the difference between $E_{\frac{1}{2}}$ and $E_{1/10}$ is particularly large and the contrast of the reproduced image is decreased, in addition to the insufficient electrostatic characteristics described above. Moreover, it is difficult to reduce the remaining potential after exposure, which results in severe fog formation in duplicated images, and when employed as offset masters, edge marks of originals pasted up appear on the prints.

SUMMARY OF THE INVENTION

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the environmental conditions during the formation of duplicated images are changed to a low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing plate precursor having excellent electrostatic characteristics (in particular, dark charge retention reproducing, faithfully duplicated images to original, forming neither overall background stains, dotted background stains nor edgemarks of original pasted up on prints, and showing excellent printing durability.

Other objects of the present invention will become apparent from the following description and examples.

It has been found that the above described objects of the present invention are accomplished by an electrophotographic light-sensitive material comprising a support having provided thereon a photoconductive layer containing at least an inorganic photoconductive substance and a binder resin, wherein the binder resin comprises (1) at least one AB block copolymer (Resin (A)) having a weight average molecular weight of from $1\times10^3$ to $2\times10^4$ and composed of an A block comprising at least one polymer component containing at least one acidic group selected from $-PO_3H_2$, $-COOH$, $-SO_3H$, a phenolic hydroxy group,

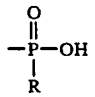

(wherein R represents a hydrocarbon group or —OR' (wherein R' represents a hydrocarbon group)) and a cyclic acid anhydride-containing group, and a B block containing at least a polymer component represented by the following general formula (I):

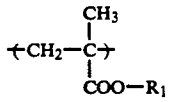

(I)

wherein $R_1$ represents a hydrocarbon group; and (2) at least one resin (Resin (B)) having a weight average molecular weight of $5\times10^4$ or more, containing a repeating unit represented by the general formula (III) described below, as a copolymerizable component, and having a crosslinked structure made before the preparation of a dispersion for forming the photoconductive layer:

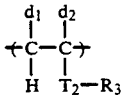

(III)

wherein $T_2$ represents —COO—, —OCO—, $-CH_2OCO-$, $-CH_2COO-$, —O—, or $-SO_2-$; $R_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, $-COOZ_4$, or $-COOZ_4$ bonded through a hydrocarbon group having from 1 to 8 carbon atoms, wherein $Z_4$ represents a hydrocarbon group having from 1 to 18 carbon atoms.

DETAILED DESCRIPTION OF THE INVENTION

The binder resin which can be used in the present invention comprises at least (1) an AB block copolymer (hereinafter referred to as resin (A)) composed of an A block comprising a component containing the above described specific acidic group and a B block comprising a polymerizable component represented by the above described general formula (I) and (2) a high molecular weight resin (hereinafter referred to as resin (B)) having the crosslinked structure previously made.

According to a preferred embodiment of the present invention, the low molecular weight resin (A) is a low molecular weight resin (hereinafter sometimes referred to as resin (A')) containing an acidic group-containing component and a methacrylate component having a specific substituent containing a benzene ring which has a specific substituent(s) at the 2-position or 2-and 6-positions thereof or a specific substituent containing an unsubstituted naphthalene ring represented by the following general formula (Ia) or (Ib):

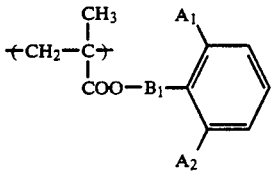

(Ia)

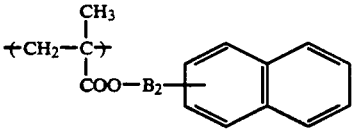

(Ib)

wherein $A_1$ and $A_2$ each represents a hydrogen atom, a hydrocarbon group having from 1 to 10 carbon atoms, a chlorine atom, a bromine atom, $-COZ_2$ or $-COOZ_2$, wherein $Z_2$ represents a hydrocarbon group having from 1 to 10 carbon atoms; and $B_1$ and $B_2$ each represents a mere bond or a linking group containing from 1 to 4 linking atoms, which connects —COO— and the benzene ring.

In another preferred embodiment of the present invention, the resin (B) is a resin in which at least one polymer main chain has at least one polar group selected from $-PO_3H_2$, $-SO_3H$, —COOH, —OH, —SH,

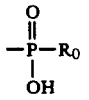

(wherein $R_0$ represents a hydrocarbon group or $—OR_0'$, wherein $R_0'$ represents a hydrocarbon group), a cyclic acid anhydride-containing group, —CHO, $—CONH_2$, $—SO_2NH_2$, and

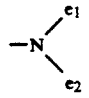

(wherein $e_1$ and $e_2$, which may be the same or different, each represents a hydrogen atom or a hydrocarbon group) at only one terminal thereof (hereinafter sometimes referred to as resin (B')).

The resin (A) used in the present invention is an AB block copolymer, the A block is composed of at least one polymerizable component containing at least one acidic group selected from the above-described specific acidic groups and the B block is composed of a polymerizable- component containing at least one of the methacrylate components represented by the general formula (I) described above, and the resin (A) has a weight average molecular weight of from $1\times10^3$ to $2\times10^4$.

The above described conventional low molecular weight resin of acidic group-containing binder resins which were known to improve the smoothness of the photoconductive layer and the electrostatic characteristics was a resin wherein acidic group-containing polymerizable components exist at random in the polymer main chain, or a resin wherein an acidic group was bonded to only one terminal of the polymer main chain.

On the other hand, the resin (A) used for the binder resin of the present invention is a copolymer wherein the acidic groups contained in the resin do not exist at random in the polymer main chain or the acidic group is not bonded to one terminal of the polymer main chain, but the acidic groups are further specified in such a manner that the acidic groups exist as a block in the polymer main chain.

It is presumed that, in the copolymer (resin (A)) used in the present invention, the domain of the portion of the acidic groups maldistributed at one terminal portion of the main chain of the polymer is sufficiently adsorbed on the stoichiometric defect of the inorganic photoconductive substance and other block portion constituting the polymer main chain mildly but sufficiently cover the surface of the photoconductive substance. Also, it is presumed that, even when the stoichiometric defect portion of the inorganic photoconductive substance varies to some extents, it always keeps a stable interaction between the inorganic photoconductive substance and the copolymer (resin (A)) used in the present invention since the copolymer has the above described sufficient adsorptive domain by the function and mechanism as described above. Thus, it has been found that, according to the present invention, the traps of the inorganic photoconductive substance are more effectively and sufficiently compensated and the humidity characteristics of the photoconductive substance are improved as compared with conventionally known acidic group-containing resins. Further, in the present invention, particles of the inorganic photoconductive substance are sufficiently dispersed in the binder to restrain the occurrence of the aggregation of the particles of the photoconductive substance. In addition, the excellent electrophotographic characteristics are stably maintained even when the environmental conditions are greatly changed from high-temperature and high-humidity to low-temperature and low-humidity.

On the other hand, the resin (B) serves to sufficiently heighten the mechanical strength of the photoconductive layer, which may be insufficient in case of using the resin (A) alone, without damaging the excellent electrophotographic characteristics attained by the use of the resin (A). Further, the excellent image forming performance can be maintained even when the environmental conditions are greatly changed as described above or in the case of conducting a scanning exposure system using a laser beam of low power.

Further, according to the present invention, the smoothness of the photoconductive layer is improved.

When an electrophotographic light-sensitive material having a photoconductive layer with a rough surface is used as an electrophotographic lithographic printing plate precursor, the dispersion state of inorganic particles such as zinc oxide particles as photoconductive substance and a binder resin is improper and thus a photoconductive layer is formed in a state containing aggregates of the photoconductive substance, whereby the surface of the non-image portions of the photoconductive layer is not uniformly and sufficiently rendered hydrophilic by applying thereto an oil-desensitizing treatment with an oil-desensitizing solution to cause attaching of printing ink at printing, which results in the formation of background stains at the non-image portions of prints.

Furthermore, it has been found that excellent photosensitivity can be obtained according to the present invention, as compared with the random copolymer resin containing the acidic groups in a side chain thereof.

Since spectral sensitizing dyes which are used for giving light sensitivity in the region of visible light to infrared light have a function of sufficiently showing the spectral sensitizing action by adsorbing on photoconductive particles, it can be assumed that the binder resin according to the present invention makes suitable interaction with photoconductive particles without hindering the adsorption of spectral sensitizing dyes onto the photoconductive particles. This effect is particularly remarkable in cyanine dyes or phthalocyanine pigments which are particularly effective as spectral sensitizing dyes for sensitization in the region of from near infrared to infrared.

It is believed that the excellent characteristics of the electrophotographic light-sensitive material may be obtained by employing the resin (A) and the resin (B) as binder resins for the inorganic photoconductive substance, wherein the weight average molecular weight of the resins, and the content and position of the acidic groups therein are specified, whereby the strength of interactions between the inorganic photoconductive substance and the resins can be appropriately controlled. More specifically, it is believed that the electrophotographic characteristics and mechanical strength of the layer can be greatly improved as described above by the fact that the resin (A) having a relatively strong interaction to the inorganic photoconductive substance selectively adsorbs thereon; whereas, the resin (B) having the adequately crosslinked structure causes an interaction between the polymer chains and the resin (B') further having the polar group at only one terminal of the main chain further causes a weak interaction between the polar group and the inorganic photoconductive particle.

In case of using the resin (A'), the electrophotographic characteristics, particularly, $V_{10}$ DRR and $E_{1/10}$ of the electrophotographic material can be furthermore improved as compared with the use of the resin (A). While the reason for this fact is not fully clear, it is believed that the polymer molecular chain of the resin (A') is suitable arranged on the surface of inorganic photoconductive substance such as zinc oxide in the layer depending on the plane effect of the benzene ring having a substituent at the ortho position or the naphthalene ring which is an ester component of the methacrylate whereby the above described improvement is achieved.

If the low molecular weight resin (A) according to the present invention is used alone as the binder resin, the resin can sufficiently adsorb onto the photoconductive substance and cover the surface thereof and thus, the photoconductive layer formed is excellent in the surface smoothness and electrostatic characteristics, provides images free from background fog and maintains a sufficient film strength for a CPC light-sensitive material or for an offset printing plate precursor giving several thousands of prints. When the resin (B) is employed together with the resin (A) in accordance with the present invention, the mechanical strength of the photoconductive layer, which may be yet insufficient by the use of the resin (A) alone, can be further increased without damaging the above-described high performance of the electrophotographic characteristics due to the resin (A). Therefore, the electrophotographic light-sensitive material of the present invention can maintain the excellent electrostatic characteristics even when the environmental conditions are widely changed, possess a sufficient film strength and form a printing plate which provides more than 8,000 prints under severe printing conditions, for example, when high printing pressure is applied in a large size printing machine.

Now, the resin (A) used in the present invention will be described in more detail below.

The content of the polymer component containing the specific acidic group in the AB block copolymer (resin (A)) of the present invention is preferably from 0.5 to 20 parts by weight, and more preferably from 3 to 15 parts by weight per 100 parts by weight of the copolymer.

If the content of the acidic group in the resin (A) is less than 0.5% by weight, the initial potential is low and thus satisfactory image density can not be obtained. On the other hand, if the content of the acidic group is larger than 20% by weight, various undesirable problems may occur, for example, the dispersibility is reduced, the film smoothness and the electrostatic characteristics under high humidity condition are reduced, and further when the light-sensitive material is used as an offset master plate, the occurrence of background stains increases.

The content of the methacrylate component represented by the general formula (I) in the block portion (B block) containing the methacrylate component represented by the general formula (I) is preferably from 30 to 100% by weight, and more preferably from 50 to 100% by weight based on the total weight of the B block.

The weight average molecular weight of the AB block copolymer (resin (A)) is from $1\times10^3$ to $2\times10^4$, and preferably from $2\times10^3$ to $1\times10^4$.

If the weight average molecular weight of the resin (A) is less than $1\times10^3$, the film-forming property of the resin is lowered, thereby a sufficient film strength cannot be maintained. On the other hand, if the weight average molecular weight of the resin (A) is higher than $2\times10^4$, the effect of the resin (A) of the present invention is reduced, thereby the electrostatic characteristics thereof become almost the same as those of conventionally known resins.

The glass transition point of the resin (A) is preferably from −10° C. to 100° C., and more preferably from −5° C. to 85° C.

Now, the polymer component containing the specific acidic group, which constitutes the A block of the AB block copolymer (resin (A)) used in the present invention will be explained in more detail below.

The acidic group contained in the resin (A) includes $-PO_3H_2$, —COOH, $-SO_3H$, a phenolic hydroxy group,

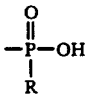

(R represents a hydrocarbon group or —OR' (wherein R' represents a hydrocarbon group)), and a cyclic acidic anhydride-containing group, and the preferred acidic groups are —COOH, $-SO_3H$, a phenolic hydroxy group, and

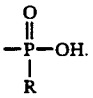

In the

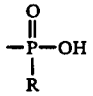

group contained in the resin (A) as an acidic group, R represents a hydrocarbon group or a —OR' group (wherein R' represents a hydrocarbon group), and, preferably, R and R' each represents an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

Examples of the phenolic hydroxy group include a hydroxy group of hydroxy-substituted aromatic compounds containing a polymerizable double bond and a hydroxy group of (meth)acrylic acid esters and amides each having a hydroxyphenyl group as a substituent.

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclo-pentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphthalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The above-described "polymerizable component having the specific acidic group" may be any vinyl compounds each having the acidic group and being capable of copolymerizing with a vinyl compound corresponding to a polymer component constituting the B block component in the resin (A) used in the present invention, for example, the methacrylate component represented by the general formula (I) described above.

For example, such vinyl compounds are described in *Macromolecular Data Handbook* (*Foundation*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

Specific examples of the compounds having the specific acidic group are set forth below, but the present invention should not be construed as being limited thereto. In the following examples, a represents —H, —$CH_3$, —Cl, —Br, —CN, —$CH_2COOCH_3$, or —$CH_2COOH$; b represents —H or —$CH_3$, n represents an integer of from 2 to 18; m represents an integer of from 1 to 12; and l represents an integer of from 1 to 4.

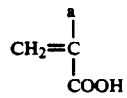
(a-1)

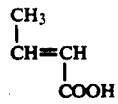
(a-2)

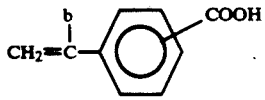
(a-3)

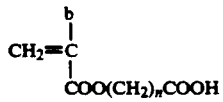
(a-4)

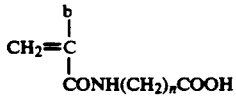
(a-5)

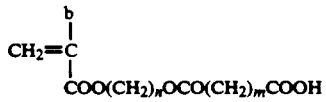
(a-6)

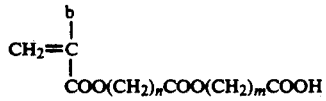
(a-7)

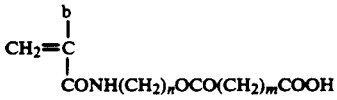
(a-8)

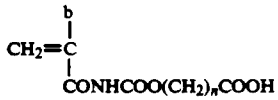
(a-9)

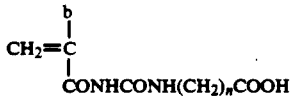
(a-10)

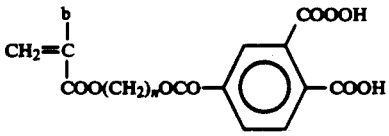
(a-11)

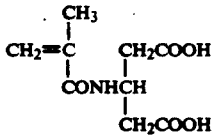
(a-12)

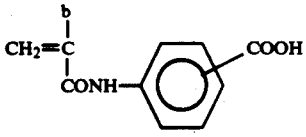
(a-13)

-continued
(a-14)
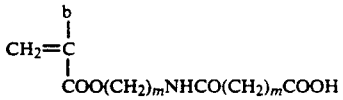
(m's may be the same of different)
(a-15)
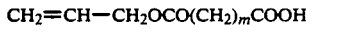
(a-16)
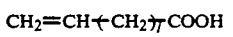
(a-17)
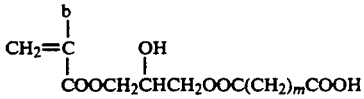
(a-18)
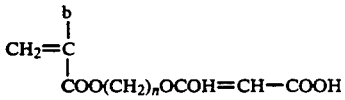
(a-19)
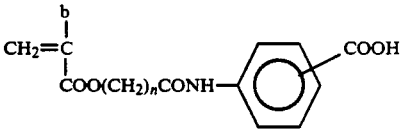
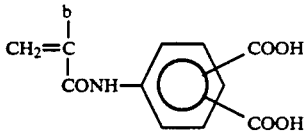
(a-21)
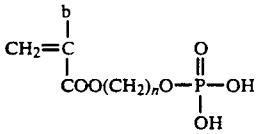
(a-22)
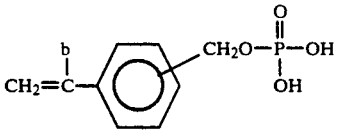
(a-23)
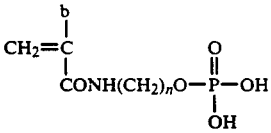
(a-24)
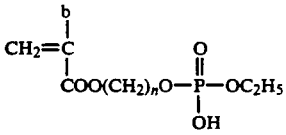
(a-25)
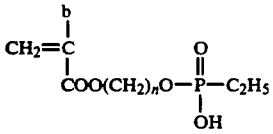
(a-26)
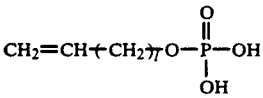
-continued
(a-27)
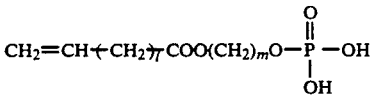
(a-28)
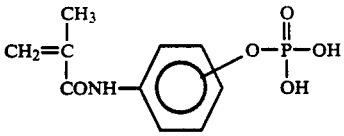
(a-29)
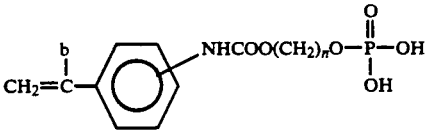
(a-30)
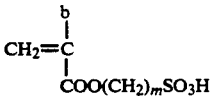
(a-31)
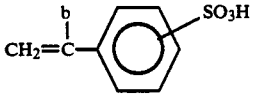
(a-32)
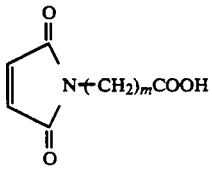
(a-33)
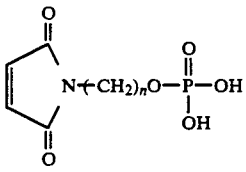
(a-34)
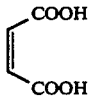
(a-35)
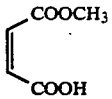
(a-36)
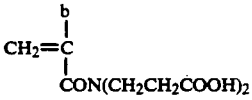
(a-37)
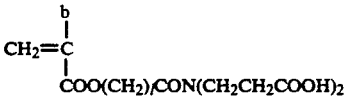
(a-38)
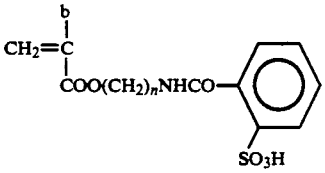

-continued

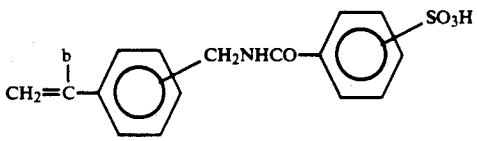
(a-39)

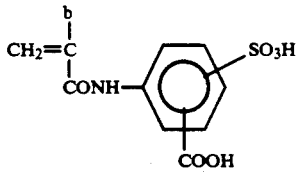
(a-40)

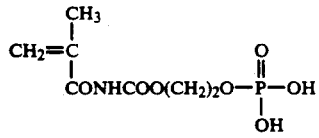
(a-41)

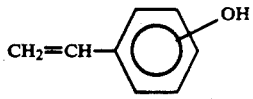
(a-42)

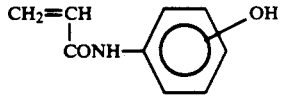
(a-43)

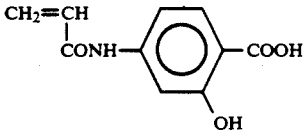
(a-44)

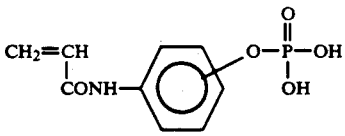
(a-45)

The A block of the AB block copolymer used in the present invention may contain two or more kinds of the polymerizable components each having the acidic group, and in this case, two or more kinds of these acidic group-containing components may be contained in the A block in the form of a random copolymer or a block copolymer.

Also, other components having no acidic group may be contained in the A block, and examples of such components include the components represented by the general formula (I) above or the general formula (II) described below. The content of the component having no acidic group in the A block is preferably from 0 to 50% by weight, and more preferably from 0 to 20% by weight. It is most preferred that such a component is not contained in the A block.

Now, the polymer component constituting the B block in the AB block copolymer (resin (A)) used in the present invention will be explained in detail below.

The B block contains at least a methacrylate component represented by the above-described general formula (I) and the methacrylate component represented by the general formula (I) is contained in the B block in an amount of preferably from 30 to 100% by weight, and more preferably from 50 to 100% by weight.

In the repeating unit represented by the general formula (I), the hydrocarbon group represented by $R_1$ may be substituted.

In the general formula (I), $R_1$ is preferably a hydrocarbon group having from 1 to 18 carbon atoms, which may be substituted. The substituent for the hydrocarbon group may be any substituent other than the above-described acidic groups contained in the polymerizable component constituting the A block of the AB block copolymer, and examples of such a substituent are a halogen atom (e.g., fluorine, chlorine, and bromine) and —O—$Z_1$, —COO—$Z_1$, and —OCO—$Z_1$ (wherein $Z_1$ represents an alkyl group having from 1 to 22 carbon atoms, e.g., methyl, ethyl, propyl, butyl, hexyl, octyl, decyl, dodecyl, hexadecyl, and octadecyl). Preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

Furthermore, it is preferred that in the resin (A), a part or all of the repeating unit represented by the general formula (I) constituting the B block is the repeating unit represented by the following general formula (Ia) and/or (Ib). Accordingly, it is preferred that at least one repeating unit represented by the following general formula (Ia) or (Ib) is contained in the B block in an amount of at least 30% by weight, and preferably from 50 to 100% by weight.

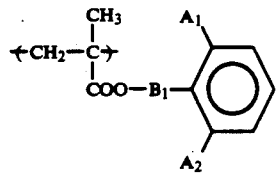
(Ia)

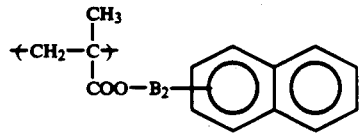
(Ib)

wherein $A_1$ and $A_2$ each represents a hydrogen atom, a hydrocarbon group having from 1 to 10 carbon atoms, a chlorine atom, a bromine atom, —$COZ_2$ or —$COOZ_2$ (wherein $Z_2$ represents a hydrocarbon group having from 1 to 10 carbon atoms); and $B_1$ and B2 each represents a mere bond or a linking group having from 1 to 4 linking atoms, which connects —COO— and the benzene ring.

By incorporating the repeating unit represented by the general formula (Ia) and/or (Ib) into the B block, more improved electrophotographic characteristics (in particular, $V_{10}$, DRR and $E_{1/10}$) can be attained as described above.

In the general formula (Ia), $A_1$ and $A_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), $—COZ_2$ or $—COOZ_2$, wherein $Z_2$ preferably represents any of the above-recited hydrocarbon groups for $A_1$ or $A_2$.

In the general formula (Ia), $B_1$ is a mere bond or a linking group containing from 1 to 4 linking atoms which connects between —COO— and the benzene ring, e.g., $\text{-}(CH_2)_{n_1}\text{-}$ (wherein $n_1$ represents an integer of 1, 2 or 3), $—CH_2CH_2OCO—$, $\text{-}(CH_2O)_{n_2}\text{-}$ (wherein $n_2$ represents an integer of 1 or 2), and $—CH_2CH_2O—$.

In the general formula (Ib), $B_2$ has the same meaning as $B_1$ in the general formula (Ia).

Specific examples of the repeating units represented by the general formula (Ia) or (Ib) which are preferably used in the B block of the resin (A) according to the present invention are set forth below, but the present invention is not to be construed as being limited thereto.

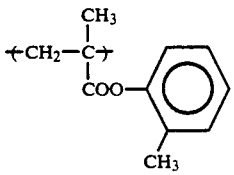
(b-1)

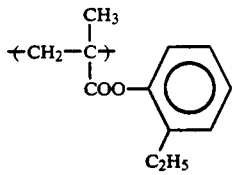
(b-2)

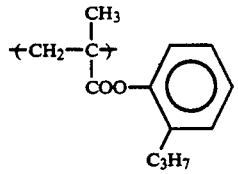
(b-3)

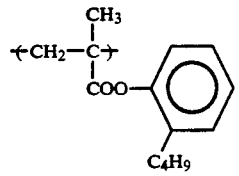
(b-4)

-continued

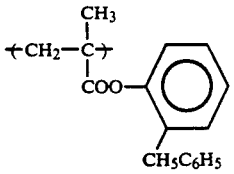
(b-5)

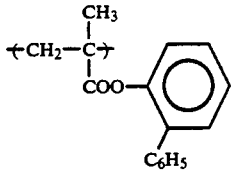
(b-6)

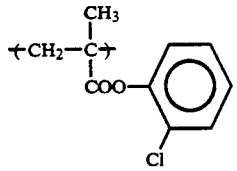
(b-7)

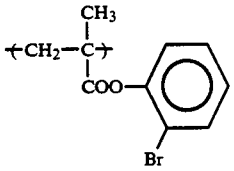
(b-8)

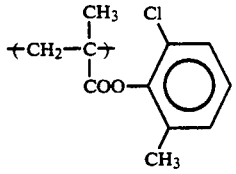
(b-9)

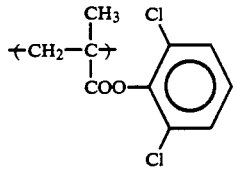
(b-10)

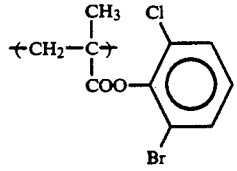
(b-11)

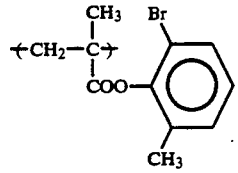
(b-12)

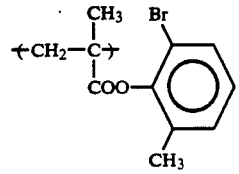
(b-13)

-continued
(b-14)
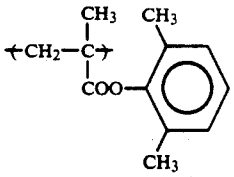
(b-15)
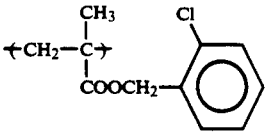
(b-16)
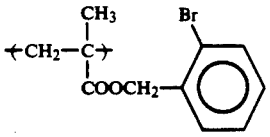
(b-17)
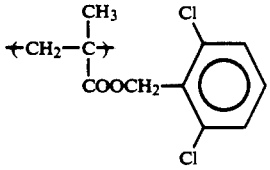
(b-18)
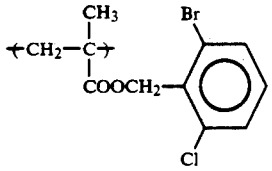
(b-19)
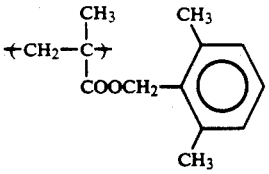
(b-20)
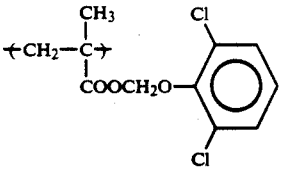
(b-21)
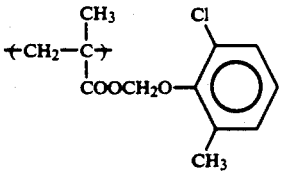
(b-22)
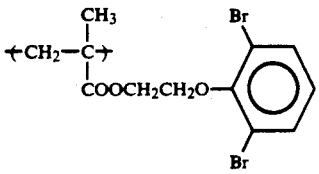
-continued
(b-23)
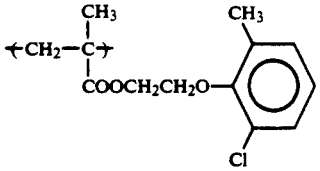
(b-24)
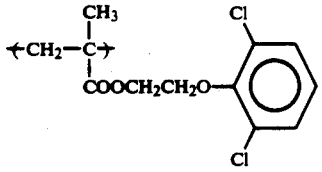
(b-25)
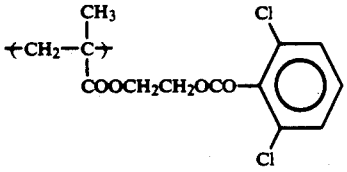
(b-26)
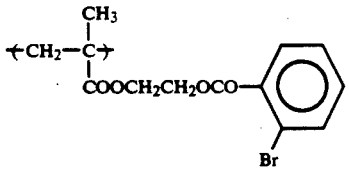
(b-27)
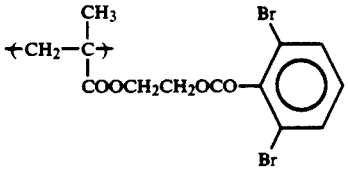
(b-28)
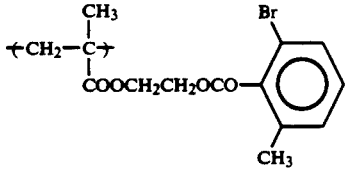
(b-29)
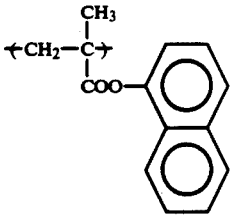
(b-30)
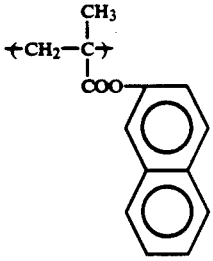

-continued (b-31)

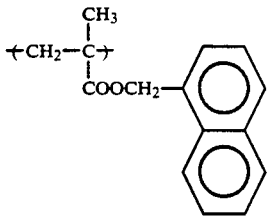

(b-32)

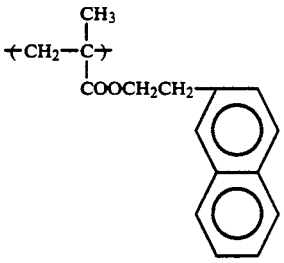

(b-33)

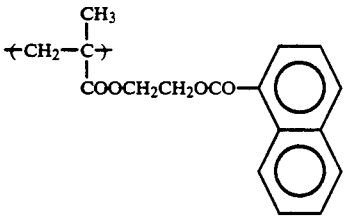

(b-34)

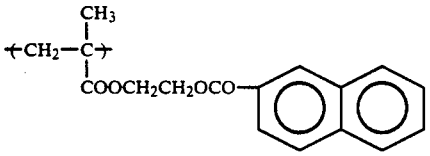

(b-35)

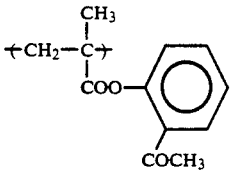

(b-36)

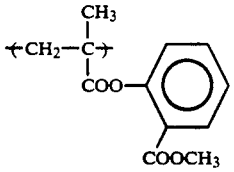

(b-37)

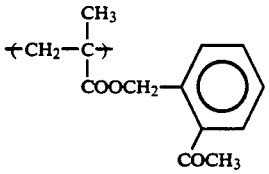

(b-38)

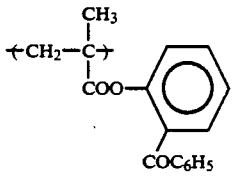

-continued (b-39)

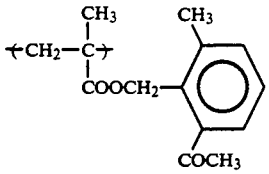

(b-40)

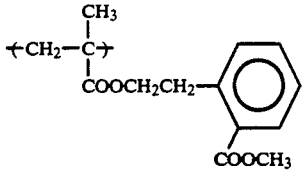

The B block which is constituted separately from the A block composed of the polymer component containing the above-described specific acidic group may contain two or more kinds of the repeating units represented by the above described general formula (I) (preferably, those of the general formula (Ia) or (Ib)) and may further contain polymer components other than the above described repeating units. When the B block having no acidic group contains two or more kinds of the polymer components, the polymer components may be contained in the B block in the form of a random copolymer or a block copolymer, but are preferably contained at random therein.

The polymer component other than the repeating units represented by the above described general formula (I), (Ia) and/or (Ib), which is contained in the B block together with the polymer component(s) selected from the repeating units represented by the general formulae (I), (Ia) and (Ib), any components copolymer with the repeating units can be used.

Examples of such other components include the repeating unit represented by the following general formula (II):

(II)

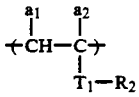

wherein $T_1$ represents —COO—, —OCO—, $-(CH_2)_{m1}$OCO—, $-(CH_2)_{m2}$COO—, —O—, $-SO_2-$,

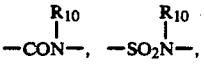

—CONHCOO—, —CONHCONH— or

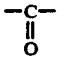

(wherein $m_1$ and $m_2$ each represents an integer of 1 or 2, $R_{10}$ has the same meaning as $R_1$ in the general formula (I)); $R_2$ has the same meaning as $R_1$ in the general formula (I); and $a_1$ and $a_2$, which may be the same or different, each represents a hydrogen atom, a halogen atom, a cyano group, a hydrocarbon group having from 1 to 8 carbon atoms, —COO—$Z_3$ or —COO—$Z_3$ bonded via a hydrocarbon group having from 1 to 8 carbon atoms (wherein $Z_3$ represents a hydrocarbon group having from 1 to 18 carbon atoms).

More preferably, in the general formula (II) $a_1$ and $a_2$, which may be the same or different, each represents a hydrogen atom, an alkyl group having from 1 to 3 carbon atoms (e.g., methyl, ethyl, and propyl), —COO—$Z_3$ or —$CH_2$COO—$Z_3$ (wherein $Z_3$ preferably represents an alkyl group having from 1 to 18 carbon atoms or an alkenyl group having from 3 to 18 carbon atoms (e.g. methyl, ethyl, propyl, butyl, hexyl, octyl, decyl, dodecyl, tridecyl, tetradecyl, hexadecyl, octadecyl, pentenyl, hexenyl, octenyl, and decenyl), and these alkyl and alkenyl groups may have a substituent as described for the above $R_1$.

Further, other monomers which constitute repeating units other than the above repeating unit include, for example, styrenes (e.g., styrene, vinyltoluene, chlorostyrene, bromostyrene, dichlorostyrene, methoxystyrene, chloromethylstyrene, methoxymethylstyrene, acetoxystyrene, methoxycarbonylstyrene, and methylcarbamoylstyrene), acrylonitrile, methacrylonitrile, acrolein, methacrolein, vinyl group-containing heterocyclic compounds (e.g., N-vinylpyrrolidone, vinylpyridine, vinylimidazole, and vinylthiophene), acrylamide, and methacrylamide, but the other copolymer components used in the present invention are not limited to these monomers.

The AB block copolymer (resin (A)) used in the present invention can be produced by a conventionally known polymerization reaction method. More specifically, it can be produced by the method comprising previously protecting the acidic group of a monomer corresponding to the polymer component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, and then conducting a protection-removing reaction of the functional group which had been formed by protecting the acidic group by a hydrolysis reaction, a hydrogenolysis reaction, an oxidative decomposition reaction, or a photodecomposition reaction to form the acidic group.

An example thereof is shown by the following reaction scheme (1):

Reaction Scheme (1)

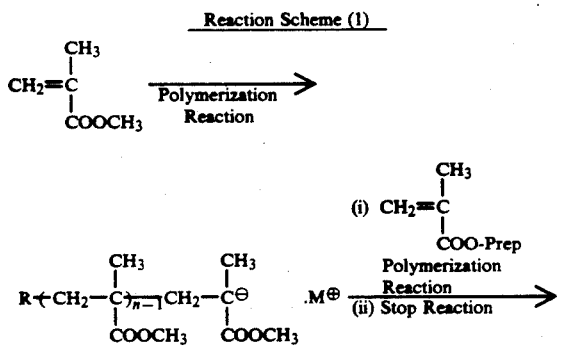

-continued

Reaction Scheme (1)

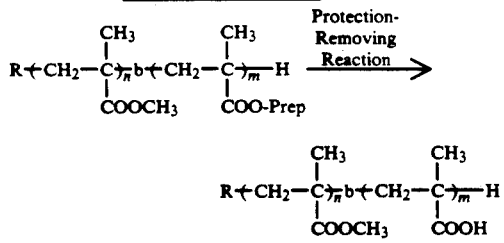

R: Alkyl group, porphyrin ring residue, etc.
Prep: Protective group (e.g., $-C(C_6H_5)_3$, $-Si(C_3H_7)_3$, etc.)
—b—: —b— represents that each of the repeating units bonded to —b— is present in the form of a block polymer component (hereinafter the same).
n, m: Repeating unit The above-described compounds can be easily synthesized according to the synthesis methods described, e.g., in P. Lutz, P. Masson et al., *Polym. Bull*, 12, 79 (1984), B. C. Anderson, G. D. Andrews et al., *Macromolecules*, 14, 1601 (1981), K. Hatada, K. Ute et al., *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler et al., *Macromolecules*, 20, 1473 (1987).

Furthermore, the AB block copolymer (resin (A)) can be also synthesized by a photoinifeter polymerization method using the monomer having the unprotected acidic group and also using a dithiocarbamate compound as an initiator. For example, the block copolymers can be synthesized according to the synthesis methods described, e.g., in Takayuki Otsu, *Kobunshi* (*Polymer*), 37, 248 (1988), Shunichi Himori and Ryuichi Otsu, *Polym. Rep. Jap.* 37, 3508 (1988), JP-A-64-111, and JP-A-64-26619.

Also, the protection of the specific acidic group of the present invention and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, Hannosei *Kobunshi* (*Reactive Polymer*), Kodansha (1977), T. W. Greene, *Protective Groups in Organic Synthesis*, John Wiley & Sons (1981), and J. F. W. McOmie, *Protective Groups in Organic Chemistry*, Plenum Press, (1973), as well as methods as described in the above references.

In the AB block copolymer (resin (A)), the content of the polymer component having the specific acidic group is from 0.5 to 20 parts by weight and preferably from 3 to 15 parts by weight per 100 parts by weight of the resin (A). The weight average molecular weight of the resin (A) is preferably from $2\times10^3$ to $1\times10^4$.

Now, the resin (B) used in the present invention will be described in greater detail below.

The resin (B) is a resin containing at least one repeating unit represented by the general formula (III), having a partially crosslinked structure, and having a weight average molecular weight of $5\times10^4$ or more, and preferably from $8\times10^4$ to $6\times10^5$.

The resin (B) preferably has a glass transition point ranging from 0° C. to 120° C., and more preferably from 10° C. to 95° C.

If the weight average molecular weight of the resin (B) is less than $5\times10^4$, the effect of improving film strength is insufficient. If it exceeds the above-described preferred upper limit, on the other hand, the resin (B) has no substantial solubility in organic solvents and thus may not be practically used.

The resin (B) is a polymer satisfying the above-described physical properties with a part thereof being crosslinked, and including a homopolymer comprising the repeating unit represented by the general formula (III) or a copolymer comprising the repeating unit of the general formula (III) and other monomer copolymer with the monomer corresponding to the repeating unit of the general formula (III).

In the general formula (III), the hydrocarbon groups may be substituted.

$T_2$ in the general formula (III) preferably represents —COO—, —OCO—, —$CH_2$OCO—, —$CH_2$COO—, or —O—, and more preferably —COO—, —$CH_2$COO—, or —O—.

$R_3$ in the general formula (III) preferably represents a substituted or unsubstituted hydrocarbon group having from 1 to 18 carbon atoms. The substituent may be any of substituents other than the above-described polar groups which may be bonded to the one terminal of the polymer main chain. Examples of such substituents include a halogen atom (e.g., fluorine, chlorine, and bromine), —O—$Z_5$, —COO—$Z_5$, and —OCO—$Z_5$, wherein $Z_5$ represents an alkyl group having from 6 to 22 carbon atoms (e.g., hexyl, octyl, decyl, dodecyl, hexadecyl, and octadecyl). Specific examples of preferred hydrocarbon groups are a substituted or unsubstituted alkyl group having from 1 to 18 carbon atoms (e.g., methyl, ethyl, propyl, butyl, pentyl, hexyl heptyl, octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), a substituted or unsubstituted alkenyl group having from 4 to 18 carbon atoms (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), a substituted or unsubstituted aralkyl group having from 7 to 12 carbon atoms (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), a substituted or unsubstituted alicyclic group having from 5 to 8 carbon atom (e.g., cyclohexyl, 2-cyclohexylethyl, and 2-cyclopentylethyl), and a substituted or unsubstituted aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, and dodecyloylamidophenyl).

In the general formula (III), $d_1$ and $d_2$, which may be the same or different, each preferably represents a hydrogen atom, a halogen atom (e.g., fluorine, chlorine, and bromine), a cyano group, an alkyl group having from 1 to 3 carbon atoms, —COO—$Z_4$, —$CH_2$COO—$Z_4$, wherein $Z_4$ preferably represents an aliphatic group having from 1 to 18 carbon atoms. More preferably, $d_1$ and $d_2$, which may be the same or different, each represents a hydrogen atom, an alkyl group having from 1 to 3 carbon atoms (e.g., methyl, ethyl, and propyl), —COO—$Z_4$, —$CH_2$COO—$Z_4$, wherein $Z_4$ more preferably represents an alkyl group having from 1 to 18 carbon atoms or an alkenyl group having from 3 to 18 carbon atoms (e.g., methyl, ethyl, propyl, butyl, hexyl, octyl, decyl, dodecyl, tridecyl, tetradecyl, hexadecyl, octadecyl, pentenyl, hexenyl, octenyl, and decenyl). These alkyl or alkenyl groups may be substituted with one or more substituents same as those described with respect to $R_3$.

In the production of the resin (B), introduction of a crosslinked structure into the polymer can be achieved by known techniques, for example, a method of conducting polymerization of monomers including the monomer corresponding to the repeating unit of the general formula (III) in the presence of a polyfunctional monomer and a method of preparing a polymer containing a crosslinking functional group and conducting a crosslinking reaction through a macromolecular reaction.

From the standpoint of ease and convenience of procedure, that is, considered that there are involved no unfavorable problems such that a long time is required for the reaction, the reaction is not quantitative, or impurities arising from a reaction accelerator are incorporated into the product, it is preferable to synthesize the resin (B) by using a self-crosslinkable functional group: —$CONHCH_2OR_{31}$ (wherein $R_{31}$ represents a hydrogen atom or an alkyl group) or by utilizing crosslinking through polymerization.

Where a polymer reactive group is used, it is preferable to copolymerize a monomer containing two or more polymer functional groups and the monomer corresponding to the general formula (III) to thereby form a crosslinked structure over polymer chains.

Specific examples of suitable polymer functional groups include $CH_2$=CH—, $CH_2$=CH—$CH_2$—,

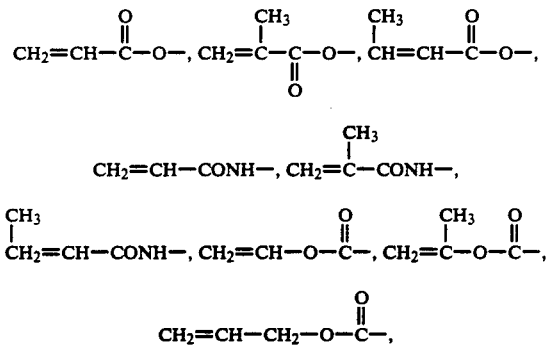

$CH_2$=CH—NHCO—, $CH_2$=CH—$CH_2$—NHCO—, $CH_2$=CH—$SO_2$—, $CH_2$=CH—CO—, $CH_2$=CH—O—, and $CH_2$=CH—S—. The two or more polymer functional groups in the monomer may be the same or different.

Specific examples of the monomer having two or more same polymer functional groups include styrene derivatives (e.g., divinylbenzene and trivinylbenzene); esters of a polyhydric alcohol (e.g., ethylene glycol, diethylene glycol, triethylene glycol, polyethylene glycol #200, #400 or #600, 1,3-butylene glycol, neopentyl glycol, dipropylene glycol, polypropylene glycol, trimethylolpropane, trimethylolethane, and pentaerythritol) or a polyhydroxyphenol (e.g., hydroquinone, resorcin, catechol, and derivatives thereof) and methacrylic acid, acrylic acid or crotonic acid; vinyl ethers, allyl ethers; vinyl esters, allyl esters, vinylamides or allylamides of a dibasic acid (e.g., malonic acid, succinic acid, glutaric acid, adipic acid, pimelic acid, maleic acid, phthalic acid, and itaconic acid); and condensates of a polyamine (e.g., ethylenediamine, 1,3-propylenediamine, and 1,4-butylenediamine) and a carboxylic acid having a vinyl group (e.g., methacrylic acid, acrylic acid, crotonic acid, and allylacetic acid).

Specific examples of the monomer having two or more different polymer functional groups include vinyl-containing ester derivatives or amide derivatives of a vinyl-containing carboxylic acid (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a reaction product of a carboxylic acid anhydride and an alcohol or an amine (e.g., allyloxycarbonylpropionic acid, allyloxycarbonylacetic acid, 2-allyloxycarbonylbenzoic acid, and allylaminocarbonylpropionic acid)) (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethyl acrylate, N-allylacrylamide, N-allylmethacrylamide, N-allylitaconic acid amide, and methacryloylpropionic acid allylamide) and condensates of an amino alcohol (e.g., aminoethanol, 1-aminopropanol, 1-aminobutanol, 1-aminohexanol, and 2-aminobutanol) and a vinyl-containing carboxylic acid.

The resin (B) having a partially crosslinked structure can be obtained by polymerization using the above-described monomer having two or more polymer functional groups in a proportion of not more than 20% by weight based on the total monomers. It is more preferable for the monomer having two or more polymer functional groups to be used in a proportion of not more than 15% by weight in cases where the polar group is introduced into the terminal by using a chain transfer agent hereinafter described, or in a proportion of not more than 5% by weight in other cases.

On the other hand, where the resin (B) contains no polar group at the terminal thereof (i.e., the resin (B) other than the resin (B')), a crosslinked structure may be formed in the resin (B) by using a resin containing a crosslinking functional group which undergoes curing on application of heat and/or light.

Such a crosslinking functional group may be any of those capable of undergoing a chemical reaction between molecules to form a chemical bond. Specifically, a mode of reaction inducing intermolecular bonding by a condensation reaction or addition reaction, or crosslinking by a polymerization reaction upon application of heat and/or light can be utilized.

Examples of the above-described crosslinking functional group include (i) at least one combination of (i-1) a functional group having a dissociative hydrogen atom (e.g., —COOH, —$PO_3H_2$,

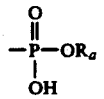

(wherein $R_a$ represents an alkyl group having from 1 to 18 carbon atoms (preferably an alkyl group having from 1 to 6 carbon atoms (e.g., methyl, ethyl, propyl, butyl, and hexyl)), an aralkyl group having from 7 to 11 carbon atoms (e.g., benzyl, phenethyl, methylbenzyl, chlorobenzyl, and methoxybenzyl), an aryl group having from 6 to 12 carbon atoms (e.g., phenyl, tolyl, xylyl, mesityl, chlorophenyl, ethylphenyl, methoxyphenyl, and naphthyl), —$OR_{32}$ (wherein $R_{32}$ has the same meaning as the hydrocarbon group for $R_a$ described above), —OH, —SH, and —$NHR_{33}$ (wherein $R_{33}$ represents a hydrogen atom or an alkyl group having from 1 to 4 carbon atoms, e.g., methyl, ethyl, propyl, and butyl)]} and (i-2) a functional group

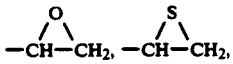

selected from the group consisting of —NCO, and —NCS; and (ii) a group containing —$CONHCH_2OR_{34}$ (wherein $R_{34}$ represents a hydrogen atom or an alkyl group having from 1 to 6 carbon atoms, e.g., methyl, ethyl, propyl, butyl, and hexyl) or a polymer double bond group.

Specific examples of the polymer double bond group are the same as those described above for the polymer functional groups.

Further, specific examples of the functional groups and compounds to be used are described, e.g., in Tsuyoshi Endo, *Netsukokasei Kobunshi no Seimitsuka*, C.M.C. K.K. (1986), Yuji Harasaki, *Saishin Binder Gijutsu Binran*, Ch. II-1, Sogo Gijutsu Center (1985), Takayuki Ohtsu, *Acryl Jushi no Gosei Sekkei to Shin Yoto Kaihatsu*, Chubu Keiei Kaihatsu Center Shuppanbu (1985), Eizo Ohmori, *Kinosei Acryl Jushi*, Techno System (1985), Hideo Inui and Gentaro Nagamatsu, *Kankosei Kobunshi*, Kodansha (1977), Takahiro Kadota, *Shin Kankosei Jushi*, Insatsu Gakkai Shuppanbu (1981), G. E. Green and B. P. Stark, *J. Macro. Sci. Revs. Macro. Chem.*, C21(2), pp. 187–273 (1981–1982), and C. G. Roffey, *Photopolymerization of Surface Coatings*, A. Wiley Interscience Pub. (1982).

These crosslinking functional groups may be present in the same copolymer component or separately in different copolymer components.

Suitable monomers corresponding to the copolymer components containing the crosslinking functional group include vinyl compounds containing such a functional group and being capable of copolymer with the monomer corresponding to the general formula (III). Examples of such vinyl compounds are described, e.g., in Kobunshi Gakkai (ed.), *Kobunshi Data Handbook (Kiso-hen)*, Baifukan (1986). Specific examples of these vinyl monomers include acrylic acid, α- and/or β-substituted acrylic acids (e.g., α-acetoxy, α-acetoxymethyl, α-(2-amino)ethyl, α-chloro, α-bromo, α-fluoro, α-tributylsilyl, α-cyano, β-chloro, β-bromo, α-chloro-β-methoxy, and α,β-dichloro compounds)), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, vinyl or allyl half ester derivatives of dicarboxylic acids, and ester or amide derivatives of these carboxylic acids or sulfonic acids containing the crosslinking functional group in the substituents thereof.

The proportion of the above-described copolymer component containing the crosslinking functional group in the resin (B) preferably ranges from 0.05 to 30% by weight, and more preferably from 0.1 to 20% by weight.

In the preparation of such a resin, a reaction accelerator may be used, if desired, to accelerate a crosslinking reaction. Examples of usable reaction accelerators include acids (e.g., acetic acid, propionic acid, butyric acid, benzenesulfonic acid, and p-toluenesulfonic acid), peroxides, azobis compounds, crosslinking agents, sensitizing agents, and photopolymer monomers. Specific examples of crosslinking agents are described, for example, in Shinzo Yamashita and Tosuke Kaneko (ed.), *Kakyozai Handbook,* Taiseisha (1981), including commonly employed crosslinking agents, such as organosilanes, polyurethanes, and polyisocyanates, and curing agents, such as epoxy resins and melamine resins.

Where the resin contains a photα-crosslinking functional group, compounds described in the literature reference with respect to photosensitive resins, for example, in Takahiro Tsunoda, *Kankosei Jushi,* Insatsu Gakkai Shuppanbu (1972), Gentaro Nagamatsu & Hideo Inui, *Kankosei Kobunshi,* Kodansha (1977), and G. A. Delgenne, *Encyclopedia of Polymer Science and Technology Supplement,* Vol. I (1976), can be used.

The resin (B) may further contain, as copolymerizable component, other monomers (e.g., those described above as optional monomers which may be present in the resin (A)), in addition to the monomer corresponding to the repeating unit of the general formula (III) and the above-described polyfunctional monomer.

While the resin (B) is characterized by having its partial crosslinked structure as stated above, it is also required to be soluble in an organic solvent used at the preparation of a dispersion for forming a photoconductive layer containing at least an inorganic photoconductive substance and the binder resin. More specifically, it is required that at least 5 parts by weight of the resin (B) be dissolved in 100 parts by weight of toluene at 25° C. Solvents which can be used in the preparation of the dispersion include halogenated hydrocarbons, e.g., dichloromethane, dichloroethane, chloroform, methylchloroform, and triclene; alcohols, e.g., methanol, ethanol, propanol, and butanol; ketones, e.g., acetone, methyl ethyl ketone, and cyclohexanone; ethers, e.g., tetrahydrofuran and dioxane; esters, e.g., methyl acetate, ethyl acetate, propyl acetate, butyl acetate, and methyl propionate; glycol ethers, e.g., ethylene glycol monomethyl ether, and 2-methoxyethylacetate; and aromatic hydrocarbons, e.g., benzene, toluene, xylene, and chlorobenzene. These solvents may be used either individually or as a mixture thereof.

According to a preferred embodiment of the resin (B), the resin (B) is a polymer (the resin (B')) having a weight average molecular weight of $5\times10^4$ or more, and preferably between $8\times10^4$ and $6\times10^5$, containing at least one repeating unit represented by the general formula (III), having a partially crosslinked structure and, in addition, having at least one polar group selected from $—PO_3H_2$, $—SO_3H$, —COOH, —OH (specifically including the phenolic hydroxy group described with respect to the resin (A), and a hydroxy group of alcohols containing a vinyl group or an allyl group (e.g., allyl alcohol), (meth)acrylates containing —OH group in the ester substituted thereof and (meth-)acrylamides containing —OH group in the N—substitutent thereof), —SH,

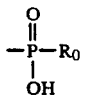

(wherein $R_0$ represents a hydrocarbon group or $—OR_0'$, wherein $R_0'$ represents a hydrocarbon group), a cyclic acid anhydride-containing group, —CHO, $—CONH_2$, $—SO_2NH_2$, and

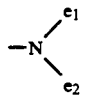

(wherein $e_1$ and $e_2$, which may be the same or different, each represents a hydrogen atom or a hydrocarbon group) bonded to only one terminal of at least one main chain thereof.

The resin (B') preferably has a glass transition point of from 0° C. to 120° C., and more preferably from 10° C. to 95° C.

The $PO_2R_0H$ and cyclic acid anhydride-containing group each of which is present in the resin (B') are the same as those described with respect to the resin (A) above.

In the polar group

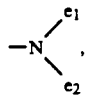

specific examples of $e_1$ and $e_2$ include a hydrogen atom, a substituted or unsubstituted aliphatic group having from 1 to 10 carbon atoms (e.g., methyl, ethyl, propyl, butyl, hexyl, octyl, 2-cyanoethyl, 2-chloroethyl, 2-ethoxycarbonylethyl, benzyl, phenethyl, and chlorobenzyl), and a substituted or unsubstituted aryl group (e.g., phenyl, tolyl, xylyl, chlorophenyl, bromophenyl, methoxycarbonylphenyl, and cyanophenyl).

Of the terminal polar groups in the resin (B'), preferred are $—PO_3H_2$, $—SO_3H$, —COOH, —OH, —SH,

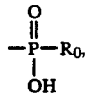

$—CONH_2$, and $—SO_2NH_2$.

In the resin (B'), the specific polar group is bonded to one terminal of the polymer main chain either directly or via an appropriate linking group. The linking group includes a carbon-carbon bond (single bond or double bond), a carbon-hetero atom bond (the hetero atom including e.g., an oxygen atom, a sulfur atom, a nitrogen atom, and a silicon atom), a hetero atom-hetero atom bond, or an appropriate combination thereof. Specific examples of linking group include

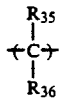

(wherein $R_{35}$ and $R_{36}$ each represents a hydrogen atom, a halogen atom (e.g., fluorine, chlorine, and bromine), a cyano group, a hydroxyl group, an alkyl group (e.g., methyl, ethyl, and propyl)),

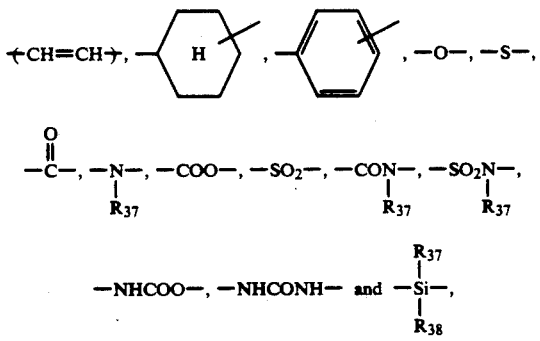

(wherein $R_{37}$ and $R_{38}$ each represents a hydrogen atom or a hydrocarbon group having from 1 to 8 carbon atoms (e.g., methyl, ethyl, propyl, butyl pentyl, hexyl, benzyl, phenethyl, phenyl, and tolyl) or $—OR_{39}$ (wherein $R_{39}$ has the same meaning as the hydrocarbon group of $R_{37}$)).

The resin (B') having the specific polar group bonded to only one terminal of at least one polymer main chain thereof can be easily synthesized by a method comprising reacting various reagents on the terminal of a living polymer obtained by conventional anion polymerization or cation polymerization (ion polymerization method), a method comprising radical polymerization using a polymerization initiator and/or chain transfer agent containing the specific polar group in its molecule (radical polymerization method), or a method comprising once preparing a polymer having a reactive group at the terminal thereof by the above-described ion polymerization method or radical polymerization method and converting the terminal reactive group into the specific polar group by a macromolecular reaction. For details, reference can be made, for example, to P. Dreyfuss and R. P. Quirk *Encycl. Polym. Sci. Eng.* 7, 551 (1987), Yoshiki Nakajo and Yuya Yamashita, *Senryo to Yakuhin*, 30, 232 (1985), and Akira Ueda and Susumu Nagai, *Kagaku to Kogyo*, 60, 57 (1986), and literature references cited therein.

In greater detail, the resin (B') can be prepared by a method in which a mixture of a monomer corresponding to the repeating unit represented by the general formula (III), the above described polyfunctional monomer for forming a crosslinked structure, and a chain transfer agent containing the specific polar group to be introduced to one terminal is polymerized in the presence of a polymerization initiator (e.g., azobis compounds and peroxides), a method using a polymerization initiator containing the specific polar group to be introduced without using the above described chain transfer agent, or a method using a chain transfer agent and a polymerization initiator both of which contain the specific polar group to be introduced. Further, the resin (B') may also be obtained by conducting polymerization using a compound having a functional group, such as an amino group, a halogen atom, an epoxy group, or an acid halide group, as the chain transfer agent or polymerization initiator according to any of the three methods set forth above, followed by reacting such a functional group through a macromolecular reaction to thereby introduce the polar group into the resulting polymer. Suitable examples of chain transfer agents used include mercapto compounds containing the polar group or a substituent capable of being converted to the polar group, e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-mercaptoethyl)amino]propionic acid, N-(3-mercaptopropionyl)-alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, and 2-mercapto-3-pyridinol; and iodoalkyl compounds containing the polar group or a substituent capable of being converted to the polar group, e.g., iodoacetic acid, iodopropionic acid, 2-iodoethanol, 2-iodoethanesulfonic acid, and 3-iodopropanesulfonic acid. Preferred of them are mercapto compounds.

The chain transfer agent or polymerization initiator is used in an amount of from 0.5 to 15 parts by weight, and preferably from 1 to 10 parts by weight, per 100 pats by weight of the total monomers.

The electrophotographic light-sensitive material according to the present invention may be required to have much greater mechanical strength while maintaining the excellent electrophotographic characteristics. For such a purpose, a method of introducing a heat- and/or photo-curable functional group into the main chain of the resin (A) can be utilized.

The heat- and/or photo-curable functional group appropriately forms a crosslinkage between the polymers to increase the interaction between the polymers and resulting in improvement of the mechanical strength of layer. Therefore, the resin further containing the heat- and/or photo-curable functional group according to the present invention increase the interaction between the binder resins without damaging the suitable adsorption and coating of the binder resins onto the inorganic photoconductive substance such as zinc oxide particles, and as a result, the film strength of the photoconductive layer is further improved.

When the resin (A) according to the present invention contains the heat- and/or photo-curable functional group described above, a crosslinking agent may be used together in order to accelerate a crosslinking reaction in the light-sensitive layer. The crosslinking agent which can be used in the present invention include compounds which are usually used as crosslinking agents. Suitable compounds are described, for example, in Shinzo Yamashita and Tosuke Kaneko (ed.), *Crosslinking Agent Handbook*, Taiseisha (1981), and *Macromolecular Data Handbook* (Foundation), edited by Kobunshi Gakkai, Baifukan (1986).

Specific examples thereof include organic silane series compounds (e.g., silane coupling agents such as vinyltrimethoxysilane, vinyltributoxysilane, γ-glycidoxypropyltrimethoxysilane, γ-mercaptopropyltriethoxysilane, and γ-aminopropyltriethoxysilane), polyisocyanate series compounds (e.g., toluylene diisocyanate, o-toluylene diisocyanate, diphenylmethane diisocyanate, triphenylmethane triisocyanate, polyethylenepolyphenyl isocyanate, hexamethylene diisocyanate, isohorone diisocyanate, and macromolecular polyisocyanate), polyol series compounds (e.g., 1,4-butanediol, polyoxypropylene glycol, polyoxyalkylene glycol, and 1,1,1-trimethylolpropane), polyamine series compounds (e.g., ethylenediamine, γ-hydroxypropylated ethylenediamine, phenylenediamine, hexamethylenediamine, N-aminoethylpiperazine, and modified aliphatic polyamines), polyepoxy group-containing compounds and epoxy resins (e.g., the compounds described, for example, in Hiroshi Kakiuchi, *New Epoxy Resin,* Shokodo (1985) and Kuniyuki Hashimoto, *Epoxy Resins,* Nikkan Kogyo Shinbunsha (1969)), melamine resins (e.g., the compounds described, for example, in Ichiro Miwa and Hideo Matsunaga, *Urea.melamine Resins,* Nikkan Kogyo Shinbunsha (1969)), and poly(-meth)acrylate series compounds (e.g., the compounds described, for example, in Shin Ohgawara, Takeo Saegusa, and Toshinobu Higashimura, *Oligomer,* Kodansha (1976), and Eizo Ohmori, *Functional Acrylic Resins, Techno System* (1985) including polyethylene glycol diacrylate, neopentyl glycol diacrylate, 1,6-hexanediol acrylate, trimethylolpropane triacrylate, pentaerythritol polyacrylate, bisphenol A-diglycidyl ether acrylate, oligoester acrylate, and their corresponding methacrylates).

The amount of the crosslinking agent used in the present invention is from 0.5 to 30% by weight, and preferably from 1 to 10% by weight, based on the total amount of the binder resin.

In the present invention, the binder resin may, if desired, contain a reaction accelerator for accelerating the crosslinking reaction of the photoconductive layer.

When the crosslinking reaction is that of a reaction type for forming a chemical bond between the functional groups, an organic acid (e.g., acetic acid, propionic acid, butyric acid, benzenesulfonic acid, and p-toluenesulfonic acid) can be used.

When the crosslinking reaction is that of a polymerization reaction type, a polymerization initiator (e.g., a peroxide, and an azobis type compound, preferably an azobis type polymerization initiator) or a monomer having a polyfunctional polymer group (e.g., vinyl methacrylate, allyl methacrylate, ethylene glycol diacrylate, polyethylene glycol diacrylate, divinylsuccinic acid esters, divinyladipic acid esters, diallylsuccinic acid esters, 2-methylvinyl methacrylate, and divinylbenzene) can be used.

The coating composition containing the resin (A) which contains the heat and/or photo-curable functional group described above according to the present invention for forming a photoconductive layer is crosslinked or subjected to thermosetting after coating. For performing crosslinking or thermosetting, a severer drying condition than that used for producing conventional electrophotographic light-sensitive materials is employed. For example, the drying step is carried out at a higher temperature and/or for a longer time. Also, after removing the solvent in the coating composition by drying, the photoconductive layer may be further subjected to a heat treatment, for example, at from 60° to 120° C. for from 5 to 120 minutes. In the case of using the above described reaction accelerator, a milder treatment condition can be employed.

The ratio of the resin (A) (including the resin (A')) to the amount of the resin (B) (including the resin (B')) used in the present invention varies depending on the kind, particle size, and surface conditions of the inorganic photoconductive substance used. In general, however, the weight ratio of the resin (A)/the resin (B) is 5 to 80/95 to 20, preferably 15 to 60/85 to 40.

In addition to the resin (A) (including the resin (A')) and the resin (B) (including the resin (B'), the resin binder according to the present invention may further comprise other resins. Suitable examples of such resins include alkyd resins, polybutyral resins, polyolefins, ethylene-vinyl acetate copolymers, styrene resins, styrene-butadiene resins, acrylate-butadiene resins, and vinyl alkanoate resins.

The proportion of these other resins should not exceed 30% by weight based on the total binder. If the proportion exceeds 30% by weight, the effects of the present invention, particularly the improvement in electrostatic characteristics, would be lost.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide and titanium oxide.

The binder resin is used in a total amount of from 10 to 100 parts by weight, preferably from 15 to 50 parts by weight, per 100 parts by weight of the inorganic photoconductive substance.

If desired, various dyes can be used as spectral sensitizers in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging,* 1973, No. 8, 12, C. J. Young et al., *RCA Review,* 15, 469 (1954), Kohei Kiyota et al., *Denkitsushin Gakkai Ronbunshi, J* 63-*C,* No. 2, 97 (1980), Yuji Harasaki et al., *Kogyo Kagaku Zasshi,* 66, 78 and 188 (1963), and Tadaaki Tani, *Nihon Shashin Gakkaishi,* 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes such as oxonol dyes, merocyanine dyes, cyanine dyes and rhodacyanine dyes include those described, for example, in F. M. Hamer, *The Cyanine Dyes and Related Compounds.* Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure,* 216, 117 to 118 (1982).

The light-sensitive material of the present invention is particularly excellent in that the performance properties are not liable to vary even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K.K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylic resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet) having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin*, 14, No. 1, 2 to 11 (1975), Hiroyuki Moriga, *Nyumon Tokushushi no Kagaku*, Kobunshi Kankokai (1975), and M. F. Hoover, *J, Macromol. Sci. Chem.*, A-4(6), 1327 to 1417 (1970).

In accordance with the present invention, an electrophotographic light-sensitive material which exhibits excellent electrostatic characteristics (particularly, under severe conditions) and mechanical strength and provides clear images of good quality can be obtained. The electrophotographic light-sensitive material according to the present invention is suitable for producing a lithographic printing plate. It is also advantageously employed in the scanning exposure system using a semiconductor laser beam.

The present invention will now be illustrated in greater detail with reference to the following examples, but it should be understood that the present invention is not to be construed as being limited thereto.

SYNTHESIS EXAMPLE A-1

Synthesis of Resin (A-1)

A mixed solution of 95 g of ethyl methacrylate, and 200 g of tetrahydrofuran was sufficiently degassed under nitrogen gas stream and cooled to −20° C. Then, 1.5 g of 1,1-diphenylbutyl lithium was added to the mixture, and the reaction was conducted for 12 hours. Furthermore, a mixed solution of 5 g of triphenylmethyl methacrylate and 5 g of tetrahydrofuran was sufficiently degassed under nitrogen gas stream, and, after adding the mixed solution to the above described mixture, the reaction was further conducted for 8 hours. The reaction mixture was adjusted to 0° C. and after adding thereto 10 ml of methanol, the reaction was conducted for 30 minutes and the polymerization was terminated.

The temperature of the polymer solution obtained was raised to 30° C. under stirring and, after adding thereto 3 ml of an ethanol solution of 30% hydrogen chloride, the resulting mixture was stirred for one hour. Then, the solvent of the reaction mixture was distilled off under reduced pressure until the whole volume was reduced to a half, and then the mixture was reprecipitated from one liter of petroleum ether.

The precipitates formed were collected and dried under reduced pressure to obtain 70 g of Resin (A-1) shown below having a weight average molecular weight (hereinafter simply referred to as Mw) of $8.5\times10^3$.

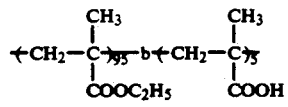

(A-1)

(weight ratio)

SYNTHESIS EXAMPLE A-2

Synthesis of Resin (A-2)

A mixed solution of 46 g of n-butyl methacrylate, 0.5 g of (tetraphenyl prophynato) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 4 g of benzyl methacrylate, after light-irradiating in the same manner as above for 8 hours, 3 g of methanol was added to the reaction mixture followed by stirring for 30 minutes, and the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates formed were collected and dried to obtain 33 g of Resin (A-2) shown below having an Mw of $9.3\times10^3$.

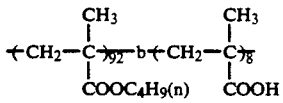

(A-2)

SYNTHESIS EXAMPLE A-3

Synthesis of Resin (A-3)

A mixed solution of 90 g of 2-chloro-6-methylphenyl methacrylate and 200 g of toluene was sufficiently degassed under nitrogen gas stream and cooled to 0° C. Then, 2.5 g of 1,1-diphenyl-3-methylpentyl lithium was added to the mixture followed by stirring for 6 hours. Further, 10 g of 4-vinylphenyloxytrimethylsilane was added to the mixture and, after stirring the mixture for 6 hours, 3 g of methanol was added to the mixture followed by stirring for 30 minutes.

Then, to the reaction mixture was added 10 g of an ethanol solution of 30% hydrogen chloride and, after stirring the mixture for one hour at 25° C., the mixture was reprecipitated from one liter of petroleum ether. The precipitates thus formed were collected, washed twice with 300 ml of diethyl ether and dried to obtain 58 g of Resin (A-3) shown below having an Mw of $7.8\times10^3$.

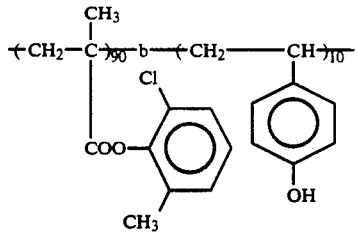

(A-3)

SYNTHESIS EXAMPLE A-4

Synthesis of Resin (A-4)

A mixed solution of 95 g of phenyl methacrylate and 4.8 g of benzyl N,N-diethyldithiocarbamate was placed in a vessel under nitrogen gas stream followed by closing the vessel and heated to 60° C. The mixture was irradiated with light from a high-pressure mercury lamp of 400 W at a distance of 10 cm through a glass filter for 10 hours to conduct photopolymerization.

Then, 5 g of acrylic acid and 180 g of methyl ethyl ketone were added to the mixture and, after replacing the gas in the vessel with nitrogen, the mixture was light-irradiated again for 10 hours.

The reaction mixture was reprecipitated from 1.5 liters of hexane and the precipitates formed were collected and dried to obtain 68 g of Resin (A-4) shown below having an Mw of $9.5\times10^3$.

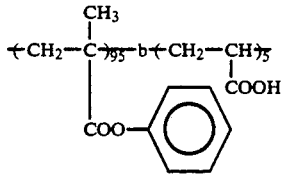

(A-4)

SYNTHESIS EXAMPLES A-5 TO A-16

Synthesis of Resins (A-5) to (A-16)

By following the similar procedures to the above-described synthesis examples of the resin (A), each of the resins (A) shown in Table 1 below were synthesized. The Mw of each resin was in the range of from $6\times10^3$ to $9.5\times10^3$.

TABLE 1

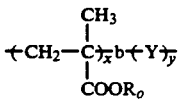

| Synthesis Example No. | Resin (A) | $-R_o$ | $-Y-$ | x/y (weight ratio) |
|---|---|---|---|---|
| 5 | A-5 | 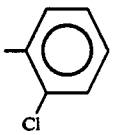 | $-CH_2-CH-$ (COOH) | 96/4 |

TABLE 1-continued
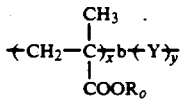
| Synthesis Example No. | Resin (A) | $-R_o$ | $-Y-$ | x/y (weight ratio) |
|---|---|---|---|---|
| 6 | A-6 | 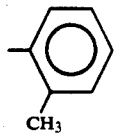 | 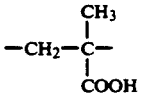 | 96/4 |
| 7 | A-7 | 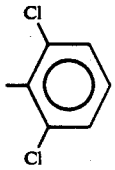 | 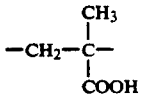 | 95/5 |
| 8 | A-8 | 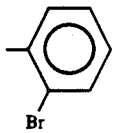 | 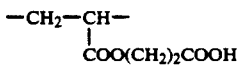 | 92/8 |
| 9 | A-9 | 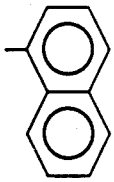 | 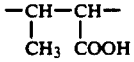 | 95/5 |
| 10 | A-10 | 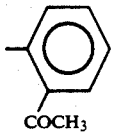 | 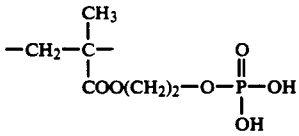 | 97/3 |
| 11 | A-11 | 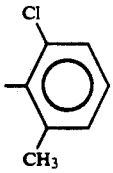 | 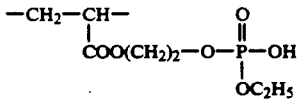 | 90/10 |
| 12 | A-12 | 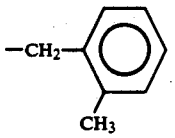 | 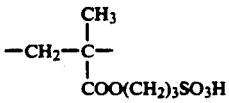 | 98/2 |
| 13 | A-13 | 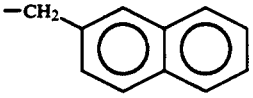 | 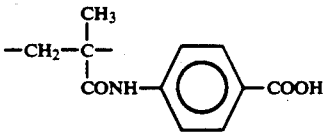 | 95/5 |

TABLE 1-continued

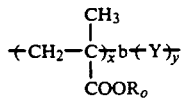

| Synthesis Example No. | Resin (A) | $-R_o$ | $-Y-$ | x/y (weight ratio) |
|---|---|---|---|---|
| 14 | A-14 | 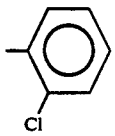 | 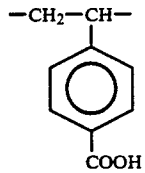 | 94/6 |
| 15 | A-15 | 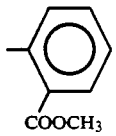 | 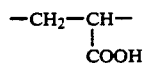 | 94/6 |
| 16 | A-16 | 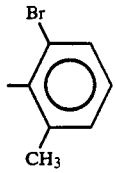 | 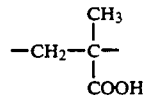 | 95/5 |
| 17 | A-17 | $-C_3H_7$ | 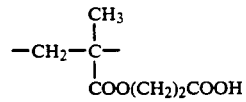 | 95/5 |
| 18 | A-18 | $-CH_2C_6H_5$ | 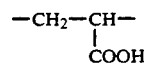 | 96/4 |

SYNTHESIS EXAMPLES A-19 TO A-23

Synthesis of Resins (A-19) to (A-23)

By following the similar procedure to Synthesis Example A-4, each of the resins (A) shown in Table 2 below were synthesized. The Mw of each resin was in the range of from $8\times10^3$ to $1\times10^4$.

TABLE 2

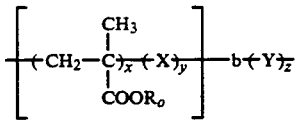

| Synthesis Example No. | Resin (A) | $-R_o$ | $-X-$ | $-Y-$ | x/y/z (weight ratio) |
|---|---|---|---|---|---|
| 19 | A-19 | $-CH_3$ | 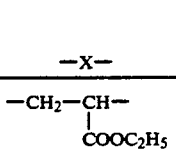 | 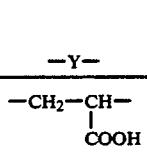 | 65/30/5 |
| 20 | A-20 | $-C_2H_5$ | 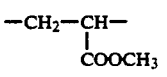 | 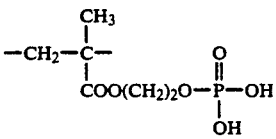 | 72/25/3 |

TABLE 2-continued

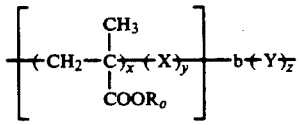

| Synthesis Example No. | Resin (A) | $-R_o$ | $-X-$ | $-Y-$ | x/y/z (weight ratio) |
|---|---|---|---|---|---|
| 21 | A-21 | 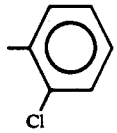 | $-CH_2-CH-$ (COOCH$_2$C$_6$H$_5$) | $-CH_2-C-$ (CH$_3$, COOH) | 81/15/4 |
| 22 | A-20 | 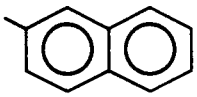 | " | $-CH-CH-$ (CH$_3$, COOH) | 75/20/5 |
| 23 | A-23 | 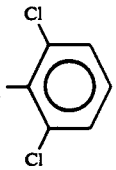 | $-CH_2-CH-$ (COOCH$_3$) | $-CH_2-CH-$ (COO(CH$_2$)$_2$COOH) | 75/20/5 |

SYNTHESIS EXAMPLE B-1

Synthesis of Resin (B-1)

A mixed solution of 100 g of ethyl methacrylate, 1.0 g of ethylene glycol dimethacrylate, and 200 g of toluene was heated to 75° C. under nitrogen gas stream, and 1.0 g of 2,2'-azobisisobutyronitrile (hereinafter simply referred to as AIBN) was added thereto to conduct a reaction for 10 hours. The resulting copolymer, i.e., Resin (B-1) had a weight average molecular weight of $4.2\times10^5$.

SYNTHESIS EXAMPLES B-2 TO B-19

Synthesis of Resins (B-2) TO (B-19)

Resins (B) shown in Table 3 below were prepared under the same polymerization conditions as in Synthesis Example B-1, except for using the monomer and crosslinking monomer shown in Table 3 below, respectively.

TABLE 3

| Synthesis Example No. | Resin (B) | Monomer | Crosslinking Monomer | Mw of Resin (B) |
|---|---|---|---|---|
| 2 | B-2 | ethyl methacrylate (100 g) | propylene glycol dimethacrylate (1.0 g) | $2.4\times10^5$ |
| 3 | B-3 | butyl methacrylate (100 g) | diethylene glycol dimethacrylate (0.8 g) | $3.4\times10^5$ |
| 4 | B-3 | propyl methacrylate (100 g) | vinyl methacrylate (3 g) | $9.5\times10^5$ |
| 5 | B-5 | methyl methacrylate (80 g) ethyl acrylate (20 g) | divinylbenzene (0.8 g) | $8.8\times10^5$ |
| 6 | B-6 | ethyl methacrylate (75 g) methyl acrylate (25 g) | diethylene glycol diacrylate (0.8 g) | $2.0\times10^5$ |
| 7 | B-7 | styrene (20 g) butyl methacrylate (80 g) | triethylene glycol trimethacrylate (0.5 g) | $3.3\times10^5$ |
| 8 | B-8 | methyl methacrylate (40 g) propyl methacrylate (60 g) | IPS-22GA (produced by Okamura Seiyu K.K.) (0.9 g) | $3.6\times10^5$ |
| 9 | B-9 | benzyl methacrylate (100 g) | ethylene glycol dimethacrylate (0.8 g) | $2.4\times10^5$ |
| 10 | B-10 | Butyl methacrylate (95 g) 2-hydroxyethyl methacrylate (5 g) | ethylene glycol dimethacrylate (0.8 g) | $2.0\times10^5$ |
| 11 | B-11 | ethyl methacrylate (90 g) acrylonitrile (10 g) | divinylbenzene (0.8 g) | $1.0\times10^5$ |
| 12 | B-12 | ethyl methacrylate (99.5 g) methacrylic acid (0.5 g) | triethylene glycol dimethacrylate (0.7 g) | $1.5\times10^5$ |
| 13 | B-13 | butyl methacrylate (70 g) phenyl methacrylate (30 g) | diethylene glycol dimethacrylate (1.0 g) | $2.0\times10^5$ |
| 14 | B-14 | ethyl methacrylate (95 g) acrylamide (5 g) | triethylene glycol dimethacrylate (1.0 g) | $2.4\times10^5$ |
| 15 | B-15 | propyl methacrylate (92 g) N,N-dimethylaminoethyl methacrylate (8 g) | divinylbenzene (1.0 g) | $1.8\times10^5$ |

TABLE 3-continued

| Synthesis Example No. | Resin (B) | Monomer | Crosslinking Monomer | Mw of Resin (B) |
|---|---|---|---|---|
| 16 | B-16 | ethyl methacrylate (70 g) methyl crotonate (30 g) | divinylbenzene (0.8 g) | $1.4 \times 10^5$ |
| 17 | B-17 | propyl methacrylate (95 g) diacetonacrylamide (5 g) | propylene glycol dimethacrylate (0.8 g) | $1.8 \times 10^5$ |
| 18 | B-18 | ethyl methacrylate (93 g) 6-hydroxyhexamethylene methacrylate (7 g) | ethylene glycol dimethacrylate (0.8 g) | $2.0 \times 10^5$ |
| 19 | B-19 | ethyl methacrylate (90 g) 2-cyanoethyl methacrylate (10 g) | ethylene glycol dimethacrylate (0.8 g) | $1.8 \times 10^5$ |

SYNTHESIS EXAMPLE B-20

Synthesis of Resin (B-20)

A mixed solution of 99 g of ethyl methacrylate, 1 g of ethylene glycol dimethacrylate, 150 g of toluene, and 50 g of methanol was heated to 70° C. under nitrogen gas stream, and 1.0 g of 4,4'-azobis(4-cyanopentanoic acid) was added thereto to conduct a reaction for 8 hours. The resulting copolymer; i.e., Resin (B-20) had a weight average molecular weight of $1.0 \times 10^5$.

SYNTHESIS EXAMPLES B-21 TO B-24

Synthesis of Resins (B-21) TO (B-24)

Resins (B) shown in Table 4 below were prepared under the same conditions as in Synthesis Example B-20, except for replacing 4,4'-azobis(4-cyanopentanoic acid) used as the polymerization initiator with each of the compounds shown in Table 4 below, respectively. The weight average molecular weight of each resin obtained was in a range of from $1.0 \times 10^5$ to $3 \times 10^5$.

SYNTHESIS EXAMPLE B-25

Synthesis of Resin (B-25)

A mixed solution of 99 g of ethyl methacrylate, 1.0 g of thioglycolic acid, 2.0 g of divinylbenzene, and 200 g of toluene was heated to 80° C. under nitrogen gas stream. To the mixture was added 0.8 g of 2,2'-azobis(-cyclohexane-1-carbononitrile) (hereinafter simply referred to as ACHN) to conduct a reaction for 4 hours. Then, 0.4 g of ACHN was added thereto, followed by reacting for 2 hours, and 0.2 g of ACHN was further added thereto, followed by reacting for 2 hours. The resulting copolymer, i.e., Resin (B-25) had a weight average molecular weight of $1.2 \times 10^5$.

SYNTHESIS EXAMPLES B-26 TO B-38

Synthesis of Resins (B-26) TO (B-38)

Resins (B) shown in Table 5 below were prepared under the same manner as in Synthesis Example B-25, except for replacing 2.0 g of divinylbenzene used as the crosslinking monomer with the polyfunctional monomer or oligomer shown in Table 5 below, respectively.

TABLE 4

| Synthesis Example No. | Resin (B) | Polymerization Initiator R—N=N—R | R— |
|---|---|---|---|
| 21 | B-21 | 2,2'-azobis(2-cyanopropanol) | $HO-CH_2-C(CH_3)(CN)$ |
| 22 | B-22 | 2,2'-azobis(2-cyanopentanol) | $HOCH_2CH_2CH_2-C(CH_3)(CN)$ |
| 23 | B-23 | 2,2'-azobis[2-methyl-N-(2-hydroxyethyl)propionamide | $HOCH_2CH_2NH-C(=O)-C(CH_3)_2$ |
| 24 | B-24 | 2,2'-azobis{2-methyl-N-[1,1-bis-hydroxymethyl)-2-hydroxyethyl]-propionamide} | $(HOCH_2)_2HOH_2C-C-NH-C(=O)-C(CH_3)_2$ |

TABLE 5

| Synthesis Example No. | Resin (B) | Crosslinking Monomer or Oligomer | Mw |
|---|---|---|---|
| 26 | B-26 | ethylene glycol dimethacrylate (2.5 g) | $2.2 \times 10^5$ |
| 27 | B-27 | diethylene glycol dimethacrylate (3 g) | $2.0 \times 10^5$ |
| 28 | B-28 | vinyl methacrylate (6 g) | $1.8 \times 10^5$ |
| 29 | B-29 | isopropenyl methacrylate (6 g) | $2.0 \times 10^5$ |
| 30 | B-30 | divinyl adipate (10 g) | $1.0 \times 10^5$ |
| 31 | B-31 | diallyl glutaconate (10 g) | $9.5 \times 10^5$ |
| 32 | B-32 | IPS-22GA (produced by Okamura Seiyu K.K.) (5 g) | $1.5 \times 10^5$ |
| 33 | B-33 | triethylene glycol diacrylate (2 g) | $2.8 \times 10^5$ |
| 34 | B-34 | trivinylbenzene (0.8 g) | $3.0 \times 10^5$ |
| 35 | B-35 | polyethylene glycol #400 diacrylate (3 g) | $2.5 \times 10^5$ |
| 36 | B-36 | polyethylene glycol dimethacrylate (3 g) | $2.5 \times 10^5$ |
| 37 | B-37 | trimethylolpropane triacrylate (0.5 g) | $1.8 \times 10^5$ |
| 38 | B-38 | polyethylene glycol #600 diacrylate (3 g) | $2.8 \times 10^5$ |

SYNTHESIS EXAMPLES B-39 TO B-49

Synthesis of Resins (B-39) TO (B-49)

A mixed solution of 39 g of methyl methacrylate, 60 g of ethyl methacrylate, 1.0 g of each of the mercapto compounds shown in Table 6 below, 2 g of ethylene glycol dimethacrylate, 150 g of toluene, and 50 g of methanol was heated to 70° C. under nitrogen gas stream. To the mixture was added 0.8 g of AIBN to conduct a reaction for 4 hours. Then, 0.4 g of AIBN was further added thereto to conduct a reaction for 4 hours. The weight average molecular weight of each copolymer obtained was in a range of $9.5 \times 10^4$ to $2 \times 10^5$.

TABLE 6

| Synthesis Example No. | Resin (B) | Mercapto Compound |
|---|---|---|
| 39 | B-39 | $CH_2COOH$ / $HSCHCOOH$ |
| 40 | B-40 | 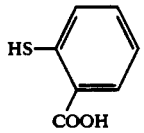 |
| 41 | B-41 | $HSCH_2CH_2NH_2$ |
| 42 | B-42 | $HSCH_2CH_2O-P(=O)(OH)-OH$ |
| 43 | B-43 | $HSCH_2CH_2O-P(=O)(OC_2H_5)-OH$ |

TABLE 6-continued

| Synthesis Example No. | Resin (B) | Mercapto Compound |
|---|---|---|
| 44 | B-44 | 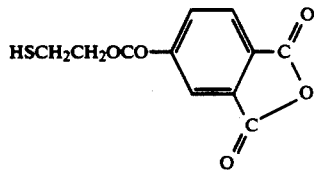 |
| 45 | B-45 | $HSCH_2CH_2COOH$ |
| 46 | B-46 | 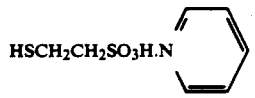 |
| 47 | B-47 | $HSCH_2CH_2NHCO(CH_2)_3COOH$ |
| 48 | B-48 | $HSCH_2CH_2N(CH_3)_2$ |
| 49 | B-49 | $HSCH_2CH_2OH$ |

EXAMPLE 1

A mixture of 6 g (solid basis, hereinafter the of Resin (A-18), 34 g (solid basis, hereinafter the same) of Resin (B-5), 200 g of zinc oxide, 0.018 g of Cyanine Dye (I) shown below, 0.15 g of salicylic acid, and 300 g of toluene was dispersed in a ball mill for 4 hours to prepare a coating composition for a light-sensitive layer. The coating composition was coated on paper, which has been subjected to electrically conductive treatment, by a wire bar at a dry coverage of 25 g/m², followed by drying at 110° C. for 30 seconds. The coated material was then allowed to stand in a dark place at 20° C. and 65% RH (relative humidity) for 24 hours to prepare an electrophotographic light-sensitive material.

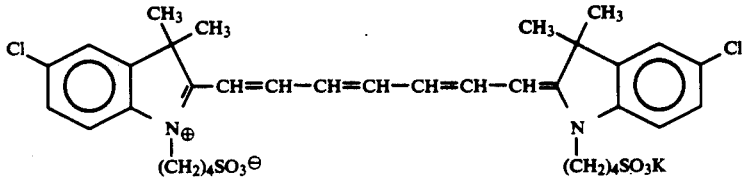

Cyanine Dye (I)

EXAMPLE 2

An electrophotographic light-sensitive material was prepared in the same manner as in Example 1 except for using 6 g of Resin (A-3) in place of 6 g of Resin (A-18).

COMPARATIVE EXAMPLE A

An electrophotographic light-sensitive material was prepared in the same manner as in Example 1, except for using 6 g of Resin (R-1) for comparison shown below in place of 6 g of Resin (A-18).

Resin (R-1):

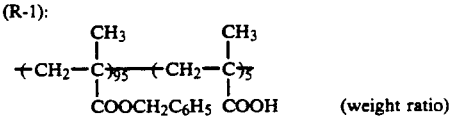

(weight ratio)

Mw: $6 \times 10^3$ (random copolymer)

COMPARATIVE EXAMPLE B

An electrophotographic light-sensitive material was prepared in the same manner as in Example 1, except for using 6 g of Resin (R-2) for comparison shown below in place of 6 g of Resin (A-18).

Resin (R-2):

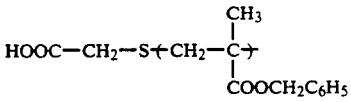

Mw: $8.0 \times 10^3$

On each of the electrophotographic light-sensitive materials thus prepared, the electrostatic characteristics and the image-forming performance under the environmental conditions of 20° C. and 65% RH (Condition I) or 30° C. and 80% RH (Condition II) were determined. The results are shown in Table 7 below.

TABLE 7

| | Example 1 | Example 2 | Comparative Example A | Comparative Example B |
|---|---|---|---|---|
| Electrostatic Characteristics*1) | | | | |
| $V_{10}$ (−V) | | | | |
| I: (20° C., 65% RH) | 565 | 650 | 550 | 555 |
| II: (30° C., 80% RH) | 550 | 630 | 530 | 545 |
| DRR (90 sec. value) (%) | | | | |
| I: (20° C., 65% RH) | 78 | 88 | 70 | 75 |
| II: (30° C., 80% RH) | 74 | 85 | 60 | 70 |
| $E_{1/10}$ (erg/cm$^2$) | | | | |
| I: (20° C., 65% RH) | 30 | 17 | 45 | 33 |
| II: (30° C., 80% RH) | 31 | 18 | 41 | 30 |
| $E_{1/100}$ (erg/cm$^2$) | | | | |
| I: (20° C., 65% RH) | 45 | 26 | 91 | 62 |
| II: (30° C., 80% RH) | 47 | 30 | 90 | 60 |
| Image Forming Performance*2) | | | | |
| I: (20° C., 65% RH) | Good | Very Good | Poor (background fog, reduced $D_M$) | No Good (reduced $D_M$, slight scratches of fine lines) |
| II: (30° C., 80% RH) | Good | Very Good | Poor (heavy background fog, scratches of fine lines) | No Good (reduced $D_M$, slight scratches of fine lines) |

The terms shown in Table 7 were evaluated as follows.

*1): Electrostatic characteristics

After applying corona discharge to the electrophotographic light-sensitive material for 20 seconds at −6 kV using a paper analyzer (Paper Analyzer Type SP-428 made by Kawaguchi Denki K.K.) in a dark place at 20° C. and 65% RH, the light-sensitive material was allowed to stand for 10 seconds and the surface potential $V_{10}$ was measured. Then, the light-sensitive material was allowed to stand in a dark place for 90 seconds and, thereafter, the surface potential $V_{100}$ was measured. The potential retentivity after decaying for 90 seconds, i.e., the dark decay retention rate [DRR (%)] was determined by the equation of $(V_{100}/V_{10}) \times 100$ (%).

Also, after charging the Surface of the photoconductive layer to −400 volts by corona discharge, the surface of the photoconductive layer was irradiated by gallium-aluminum-arsenic semiconductor laser (oscillation wavelength 780 nm), the time required to decay the surface potential ($V_{10}$) to 1/10 was measured, and from the value, the exposure amount $E_{1/10}$ (erg/cm$^2$) was calculated.

Further, in the same manner as described above the time required to decay the surface potential ($V_{10}$) to 1/100 was measured, and from the value, the exposure amount $E_{1/100}$ (erg/cm$^2$) was calculated.

The environmental conditions at the measurement was 20° C. and 65% RH (Condition I) or 30° C. and 80% RH (Condition II).

*2): Image-forming performance

After allowing to stand the electrophotographic light-sensitive material for one day and night under the environmental conditions of 20° C. and 65% RH (Condition I) or 30° C. and 80% RH (Condition II), each light-sensitive material was charged to −6 kV, and after scanning the surface of the light-sensitive material using a gallium-aluminum-arsenic semiconductor laser (oscillation wavelength: 780 nm; output: 2.8 mW) as the light source at a pitch of 25 μm and a scanning speed of 300 meters/second under the illuminance of 64 erg/cm$^2$, the light-sensitive material was developed using a liquid developer (ELP-T made by Fuji Photo Film Co., Ltd.) and fixed. Then, the duplicated images (fog and image quality) were visually evaluated.

As shown in Table 7 above, each of the electrophotographic light-sensitive material according to the present invention had good electrostatic characteristics and provided the clear duplicated images having good image quality without background fog.

On the other hand, in the electrophotographic light-sensitive materials in Comparative Examples A and B, the initial potential ($V_{10}$) and the photosensitivity ($E_{1/10}$ and $E_{1/100}$) were lowered, and the density ($D_M$) of the duplicated images was lowered, whereby fine lines and letters were blurred and also background fog was formed.

In particular, the $E_{1/100}$ value of the light-sensitive material according to the present invention is quite different from that of the light-sensitive material for comparison.

The value of $E_{1/100}$ indicates an electrical potential remaining in the non-image areas after exposure at the practice of image formation. The smaller this value, the less the background stains in the non-image areas. More specifically, it is requested that the remaining potential is decreased to −10 V or less. Therefore, an amount of exposure necessary to make the remaining potential below −10 V is an important factor. In the scanning exposure system using a semiconductor laser beam, it is quite important to make the remaining potential below −10 V by a small exposure amount in view of a design for an optical system of a duplicator (such as cost of the device, and accuracy of the optical system).

The above-described results indicate that, only when the binder resin according to the present invention is used, the electrophotographic light-sensitive materials having satisfactory electrostatic characteristics are obtained. Furthermore, in the case of using the binder resin according to the present invention, it has been noted that the electrophotographic light-sensitive material of Example 2 using the resin (A') containing methacrylate component having the specific substituent exhibits better electrostatic characteristics than the electrophotographic light-sensitive material of Example 1 and, in particular, the former case is more advantageous in the semiconductor laser light scanning exposure system.

EXAMPLE 3

A mixture of 6 g of Resin (A-5), 34 g of Resin (B-20) shown below, 200 g of zinc oxide, 0.018 g of Cyanine Dye (II) shown below, 0.30 g of phthalic anhydride, and 300 g of toluene was dispersed in a ball mill for 4 hours to prepare a coating composition for a light-sensitive layer. The coating composition was coated on paper, which had been subjected to an electrically conductive treatment, by a wire bar at a dry coverage of 22 g/m², dried at 100° C. for 30 seconds. The coated material was allowed to stand in a dark place for 24 hours under the conditions of 20° C. and 65% RH to prepare an electrophotographic light-sensitive material.

Cyanine Dye (II):

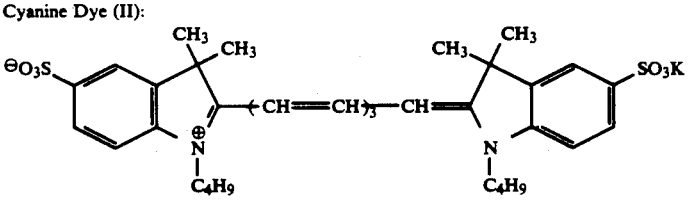

With the light-sensitive material thus prepared, the film properties in terms of surface smoothness, and the electrostatic characteristics, the image-forming performance and the printing durability under the environmental conditions of 20° C. and 65% RH or 30° C. and 80% RH were determined.

The results obtained are shown in Table 8 below.

TABLE 8

| | Example 3 |
|---|---|
| Smoothness of Photoconductive Layer*3) (sec/cc) | 500 |
| Electrostatic Characteristics | |
| $V_{10}$ (−V) | |
| I: (20° C., 65% RH) | 590 |
| II: (30° C., 80% RH) | 580 |
| DRR (90 sec. value) (%) | |
| I: (20° C., 65% RH) | 88 |
| II: (30° C., 80% RH) | 85 |
| $E_{1/10}$ (erg/cm²) | |
| I: (20° C., 65% RH) | 18 |
| II: (30° C., 80% RH) | 17 |
| $E_{1/100}$ (erg/cm²) | |
| I: (20° C., 65% RH) | 27 |
| II: (30° C., 80% RH) | 29 |
| Image-Forming Performance | |
| I: (20° C., 65% RH) | Very Good |
| II: (30° C., 80% RH) | Very Good |
| Contact Angle with Water*4) (°) | 10 or less |
| Printing Durability*5) | 10,000 |

The evaluations described in Table 8 were conducted as follows.

*3): Smoothness of Photoconductive Layer

The smoothness (sec/cc) of the electrophotographic light-sensitive material was measured using a Back's smoothness test machine (manufactured by Kumagaya Riko K.K.) under an air volume condition of 1 cc.

*4) Contact Angle with Water

After the photoconductive layer of the electrophotographic light-sensitive material was subjected to an oil-desensitizing treatment by passing once through an etching processor using a solution formed by diluting an oil-desensitizing solution ELP-EX (made by Fuji Photo Film Co., Ltd.) to a 2-fold volume with distilled water, a water drop of 2 μl of distilled water was placed on the surface and the contact angle with the water drop formed was measured with a goniometer.

*5): Printing Durability

The light-sensitive material was subjected to plate making in the same manner as the image-forming performance in the above-described *2) to form a toner image and then subjected an oil-desensitizing treatment under the same condition as in *4) above. The printing plate thus prepared was mounted on an offset printing machine (Oliver 52 Type manufactured by Sakurai Seisakusho K.K.) as an offset master plate followed by printing. The number of prints obtained without the occurrence of background stains at the non-image portions and problems on the image quality of the image portions of the prints was referred to as the printing durability. (The larger the number of prints, the better the printing durability.)

As shown in Table 8 above, the electrophotographic light-sensitive material according to the present invention has the good smoothness, of the photoconductive layer and the good electrostatic characteristics, and provides the clear duplicated images without background fog. This is presumed to be obtained by that the binder resin is sufficiently adsorbed onto particles of the photoconductive substance and the binder resin coats the surface of the particles.

Also, when the light-sensitive material is used as an offset master plate precursor, an oil-desensitizing treatment with an oil-desensitizing solution sufficiently proceeded and the contact angle between the non-image portion and a water drop was as small as less than 10 degree, which indicated the non-image portion was sufficiently rendered hydrophilic. When the plate was actually used for printing, no background stains was observed on the prints obtained and 10,000 prints having a clear image quality were obtained.

The above results indicate that the film strength is greatly improved by the action of the resin (B) without damaging the action of the resin (A).

EXAMPLES 4 TO 19

Each electrophotographic light-sensitive material was prepared in the same manner as described in Example 1, except for replacing Resin (A-18) and Resin (B-5) with each of the resins (A) and (B) shown in Table 9 below, respectively.

The electrostatic characteristics of the resulting light-sensitive materials were evaluated in the same manner as described in Example 1. The results obtained are shown in Table 9 below. The electrostatic characteristics in Table 9 are those determined under Condition II (30° C. and 80% RH).

TABLE 9

| Example No. | Resin (A) | Resin (B) | $V_{10}$ (−V) | DRR (%) | $E_{1/10}$ (erg/cm$^2$) | $E_{1/100}$ (erg/cm$^2$) |
|---|---|---|---|---|---|---|
| 4 | A-4 | B-20 | 550 | 79 | 30 | 48 |
| 5 | A-3 | B-20 | 630 | 86 | 20 | 30 |
| 6 | A-6 | B-25 | 565 | 81 | 22 | 33 |
| 7 | A-7 | B-25 | 645 | 85 | 21 | 30 |
| 8 | A-8 | B-25 | 600 | 84 | 20 | 29 |
| 9 | A-9 | B-26 | 580 | 85 | 21 | 29 |
| 10 | A-10 | B-33 | 550 | 82 | 24 | 32 |
| 11 | A-11 | B-34 | 530 | 83 | 25 | 36 |
| 12 | A-12 | B-27 | 540 | 78 | 32 | 43 |
| 13 | A-13 | B-39 | 565 | 80 | 26 | 38 |
| 14 | A-14 | B-40 | 580 | 83 | 19 | 27 |
| 15 | A-15 | B-42 | 560 | 80 | 23 | 35 |
| 16 | A-1 | B-43 | 500 | 73 | 40 | 49 |
| 17 | A-20 | B-44 | 515 | 72 | 42 | 50 |
| 18 | A-22 | B-46 | 575 | 80 | 23 | 34 |
| 19 | A-23 | B-47 | 640 | 86 | 20 | 28 |

Further, when these electrophotographic light-sensitive materials were subjected to plate making to prepare offset master plates and conducting printing using them under the same printing condition as described in Example 1, more than 10,000 good prints were obtained respectively.

It can be seen from the results described above that each of the light-sensitive materials according to the present invention was satisfactory in all aspects of the surface smoothness and film strength of the photoconductive layer, electrostatic characteristics, and printing suitability.

Further, it can be seen that the electrostatic characteristics are further improved by the use of the resin (A').

EXAMPLES 20 TO 29

Each electrophotographic light-sensitive material was prepared in the same manner as described in Example 1, except for replacing 6 g of Resin (A-18) with 6.5 g each of the resins (A) shown in Table 10 below, replacing 34 g of Resin (B-5) with 33.5 g each of the resins (B) shown in Table 10 below, and replacing 0.018 g of Cyanine Dye (I) with 0.019 g of Cyanine Dye (III) shown below.

Cyanine Dye (III):

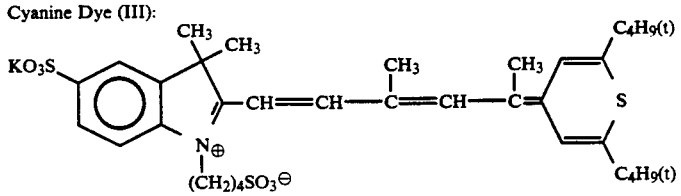

TABLE 10

| Example No. | Resin (A) | Resin (B) |
|---|---|---|
| 20 | A-2 | B-9 |
| 21 | A-3 | B-16 |
| 22 | A-7 | B-4 |
| 23 | A-9 | B-24 |
| 24 | A-10 | B-27 |
| 25 | A-11 | B-33 |
| 26 | A-12 | B-20 |
| 27 | A-13 | B-42 |
| 28 | A-20 | B-45 |
| 29 | A-22 | B-47 |

As the results of the evaluation as described in Example 1, it can be seen that each of the light-sensitive materials according to the present invention is excellent in charging properties, dark charge retention rate, and photosensitivity, and provides a clear duplicated image free from background fog even when processed under severe conditions of high temperature and high humidity (30° C. and 80% RH). Further, when these materials were employed as offset master plate precursors, more than 10,000 prints of a clear image free from background stains were obtained respectively.

EXAMPLES 30 AND 31

A mixture of 6.5 g of Resin (A-1) (Example 30) or Resin (A-14) (Example 31), 33.5 g of Resin (B-25), 200 g of zinc oxide, 0.02 g of uranine, 0.03 g of Methine Dye (D) shown below, 0.03 G of Methine Dye (E) shown below, 0.18 g of p-hydroxybenzoic acid, and 300 g of toluene was dispersed in a ball mill for 4 hours to prepare a coating composition for a light-sensitive layer. The coating composition was coated on paper, which had been subjected to electrically conductive treatment, by a wire bar at a dry coverage of 25 g/m$^2$, and dried for 20 seconds at 110° C. Then, the coated material was allowed to stand in a dark place for 24 hours under the conditions of 20° C. and 65% RH to prepare each electrophotographic light-sensitive material.

Methine Dye (D):

-continued

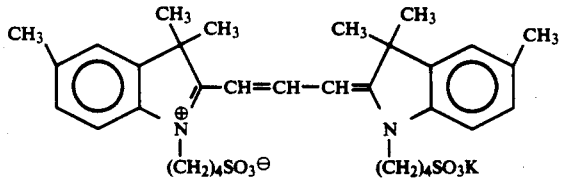

Methine Dye (E):

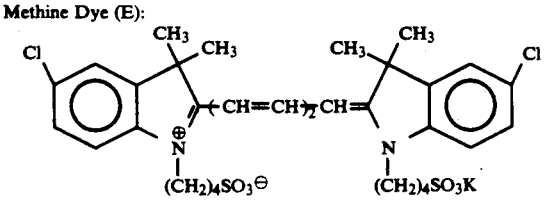

COMPARATIVE EXAMPLE C

An electrophotographic light-sensitive material was prepared in the same manner as in Example 30, except for replacing 6.5 g of Resin (A-1) with 6.5 g of Resin (R-2) described above.

Each of the light-sensitive materials obtained in Examples 30 and 31 and Comparative Example C was evaluated in the same manner as in Example 1, except that the electrostatic characteristics and image forming performance were evaluated according to the following test methods.

7) Electrostatic Characteristics: $E_{1/10}$ and $E_{1/100}$

The surface of the photoconductive layer was charged to −400 V with corona discharge, then irradiated by visible light of the illuminance of 2.0 lux, the time required for decay of the surface potential ($V_{10}$) to 1/10 or 1/100 thereof, and the exposure amount $E_{1/10}$ or $E_{1/100}$ (lux·sec) was calculated therefrom.

8) Image Forming Performance

The electrophotographic light-sensitive material was allowed to stand for one day under the environmental conditions of 20° C. and 65% RH (Condition I) or 30° C. and 80% RH (Condition II), the light-sensitive material was subjected to plate making by a full-automatic plate making machine (ELP-404 V made by Fuji Photo Film Co., Ltd.) using ELP-T as a toner. The duplicated image thus obtained was visually evaluated for fog and image quality. The original used for the duplication was composed of cuttings of other originals pasted up thereon.

The results obtained are shown in Table 11 below.

TABLE 11

| | Example 30 | Example 31 | Comparative Example C |
|---|---|---|---|
| Binder Resin | (A-1)/B-25) | (A-14)/(B-25) | (R-2)/B-25) |
| Surface Smoothness (sec/cc) | 450 | 460 | 450 |
| Electrostatic[7)] Characteristics: | | | |
| $V_{10}$ (−V): | | | |
| Condition I | 560 | 630 | 560 |
| Condition II | 545 | 610 | 540 |
| DRR (%): | | | |
| Condition I | 90 | 96 | 90 |
| Condition II | 85 | 93 | 83 |
| $E_{1/10}$ (lux.sec): | | | |
| Condition I | 9.3 | 8.3 | 10.4 |
| Condition II | 9.8 | 9.0 | 11.8 |
| $E_{1/100}$ (lux.sec): | | | |
| Condition I | 14 | 12.5 | 26 |
| Condition II | 15 | 13.6 | 28 |
| Image-Forming Performance[8)]: | | | |
| Condition I | Good | Very Good | Poor (edge mark of cutting) |
| Condition II | Good | Very Good | Poor (sever edge mark of cutting) |
| Contact Angle With Water (°) | 10 or less | 10 or less | 10 or less |
| Printing Durability: | 10,000 | 10,000 | Background stains due to edge mark of cutting from the start of printing |

From the results shown in Table 11 above, it can be seen that each light-sensitive material exhibits almost same properties with respect to the surface smoothness of the photoconductive layer. However, on the electrostatic characteristics, the sample of Comparative Example C has the particularly large value of $E_{1/100}$ which becomes larger under the high temperature and high humidity conditions. On the contrary, the electrostatic characteristics of the light-sensitive material according to the present invention are good. Further, those of Example 31 using the resin (A') having the specific substituent are very good. The value of $E_{1/100}$ is particularly small.

With respect to image-forming performance, the edge mark of cuttings pasted up was observed as background fog in the non-image areas in the sample of Comparative Example C. On the contrary, the samples according to the present invention provided clear duplicated images free from background fog.

Further, each of these samples was subjected to the oil-desensitizing treatment to prepare an offset printing plate and printing was conducted. The samples according to the present invention provided 10,000 prints of clear image without background stains. However, with the sample of Comparative Example C, the above described edge mark of cuttings pasted up was not removed with the oil-desensitizing treatment and the background stains occurred from the start of printing.

As can be seen from the above results, only the light-sensitive material according to the present invention can provide the excellent performance.

EXAMPLES 32 TO 43

Each electrophotographic light-sensitive material was prepared in the same manner as described in Example 30, except for replacing 6.5 g Resin (A-1) with 6.5 g of each of the resins (A) shown in Table 12 below, and replacing 33.5 g of Resin (B-25) with 33.5 g of each of the resins (B) shown in Table 12 below, respectively.

TABLE 12

| Example No. | Resin (A) | Resin (B) |
|---|---|---|
| 32 | A-2 | B-1 |
| 33 | A-3 | B-5 |
| 34 | A-4 | B-6 |
| 35 | A-6 | B-9 |
| 36 | A-17 | B-11 |
| 37 | A-18 | B-12 |
| 38 | A-19 | B-16 |
| 39 | A-20 | B-19 |
| 40 | A-21 | B-23 |
| 41 | A-23 | B-34 |
| 42 | A-5 | B-39 |
| 43 | A-8 | B-42 |

As the results of the evaluation as described in Example 30, it can be seen that each of the light-sensitive materials according to the present invention is excellent in charging properties, dark charge retention rate, and photosensitivity, and provides a clear duplicated image free from background fog and scratches of fine lines even when processed under severe conditions of high temperature and high humidity (30° C. and 80% RH). Further, when these materials were employed as offset master plate precursors, more than 8,000 prints of a clear image free from background stains were obtained respectively.

EXAMPLE 44

A mixture of 8 g of Resin (A-24) shown below and 28 g of Resin (B-10), 200 g of zinc oxide, 0.02 g of uranine, 0.04 g of Rose Bengal, 0.03 g of bromophenol blue, 0.40 g of phthalic anhydride and 300 g of toluene was dispersed in a ball mill for 4 hours. Then, to the dispersion was added 3.5 g of 1,3-xylylenediisocyanate, and the mixture was dispersed in a ball mill for 5 minutes.

The dispersion was coated on paper, which had been subjected to an electroconductive treatment, by a wire bar in a dry coverage of 20 g/m$^2$, heated for one minute at 110° C. and then heated for 1.5 hours at 120° C. Then, the coated material was allowed to stand in a dark place for 24 hours under the condition of 20° C. and 65% RH to prepare an electrophotographic light-sensitive material.

Resin (A-24):

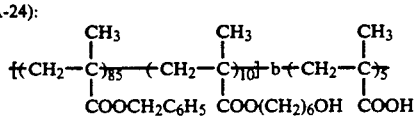

Mw: 9.5 × 10$^3$

As the results of the evaluation as described in Example 30, it can be seen that the light-sensitive material according to the present invention is excellent in charging properties, dark charge retention rate, and photosensitivity, and provides a clear duplicated image free from background fog under severe conditions of high temperature and high humidity (30° C. and 80% RH). Further, when the material was employed as an offset master plate precursor, 10,000 prints of a clear image were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon a photoconductive layer containing at least an inorganic photoconductive substance and a binder resin, wherein the binder resin comprises (1) at least one AB block copolymer (Resin (A)) having a weight average molecular weight of from $1\times10^3$ to $2\times10^4$ and composed of an A block comprising at least one polymer component containing at least one acidic group selected from $-PO_3H_2$, $-COOH$, $-SO_3H$, a phenolic hydroxy group,

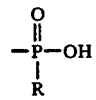

(wherein R represents a hydrocarbon group or —OR' (wherein R' represents a hydrocarbon group)) and a cyclic acid anhydride-containing group, and a B block containing at least a polymer component represented by the following general formula (I):

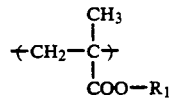

(I)

wherein $R_1$ represents a hydrocarbon group; and (2) at least one resin (Resin (B)) having a weight average molecular weight of $5\times10^4$ or more, containing a repeating unit represented by the general formula (III) described below, as a copolymer component, and having a crosslinked structure made before the preparation of a dispersion for forming the photoconductive layer:

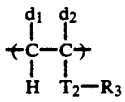

(III)

wherein $T_2$ represents —COO—, —OCO—, $-CH_2OCO-$, $-CH_2COO-$, —O—, or $-SO_2-$; $R_3$ represents a hydrocarbon group having from 1 to 22 carbon atoms; and $d_1$ and $d_2$, which may be the same or different, each represents a hydrogen atom, a halogen atom, a cyano group, a hydrocarbon group having from 1 to 8 carbon atoms, $-COOZ_4$, or $-COOZ_4$ bonded through a hydrocarbon group having from 1 to 8 carbon atoms, wherein $Z_4$ represents a hydrocarbon group having from 1 to 18 carbon atoms.

2. An electrophotographic light-sensitive material as claimed in claim 1, wherein the copolymer component represented by the general formula (I) is a copolymer component represented by the following general formula (Ia) or (Ib):

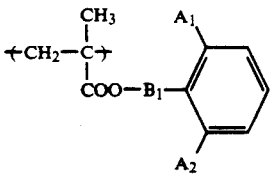

(Ia)

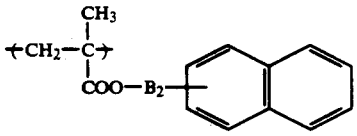

(Ib)

wherein $A_1$ and $A_2$ each represents a hydrogen atom, a hydrocarbon group having from 1 to 10 carbon atoms, a chlorine atom, a bromine atom, $—COZ_2$ or $—COOZ_2$, wherein $Z_2$ represents a hydrocarbon group having from 1 to 10 carbon atoms; and $B_1$ and $B_2$ each represents a mere bond or a linking group containing from 1 to 4 linking atoms, which connects —COO— and the benzene ring.

3. An electrophotographic light-sensitive material as claimed in claim 2, wherein the linking group containing from 1 to 4 linking atoms represented by $B_1$ or $B_2$ is $\text{-}(CH_2)_{n_1}\text{-}$ ($n_1$ represents an integer of 1, 2 or 3), $—CH_2CH_2OCO—$, $\text{-}(CH_2O)_{n_2}\text{-}$ ($n_2$ represents an integer of 1 or 2), or $—CH_2CH_2O—$.

4. An electrophotographic light-sensitive material as claimed in claim 1, wherein the content of the polymer component containing the acidic group in the AB block copolymer is from 0.5 to 20 parts by weight per 100 parts by weight of the AB block copolymer.

5. An electrophotographic light-sensitive material as claimed in claim 1, wherein the content of the polymer component represented by the general formula (I) in the B block is from 30 to 100% by weight based on the total weight of the B block.

6. An electrophotographic light-sensitive material as claimed in claim 1, wherein the block B further contains a polymer component represented by the following general formula (II):

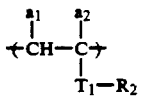

(II)

wherein $T_1$ represents —COO—, —OCO—, $—CH_2)_{m_1}OCO—$, $—CH_2)_{m_2}COO—$, —O—, $—SO_2—$,

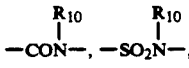

—CONHCOO—, —CONHCONH—

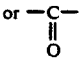

(wherein $m_1$ and $m_2$ each represents an integer of 1 or 2, $R_{10}$ has the same meaning as $R_1$ in the general formula (I)); $R_2$ has the same meaning as $R_1$ in the general formula (I); and $a_1$ and $a_2$, which may be the same or different, each represents a hydrogen atom, a halogen atom, a cyano group, a hydrocarbon group having from 1 to 8 carbon atoms, $—COO—Z_3$ or $—COO—Z_3$ bonded via a hydrocarbon group having from 1 to 8 carbon atoms (wherein Z3 represents a hydrocarbon group having from 1 to 18 carbon atoms).

7. An electrophotographic light-sensitive material as claimed in claim 1, wherein the weight average molecular weight of the resin (B) is from $8\times10^4$ to $6\times10^5$.

8. An electrophotographic light-sensitive material as claimed in claim 1, wherein the resin (B) has at least one polar group selected from $—PO_3H_2$, $—SO_3H$, —COOH, —OH, —SH,

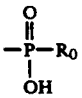

(wherein $R_0$ represents a hydrocarbon group or $—OR_0'$, wherein $R_0'$ represents a hydrocarbon group), a cyclic acid anhydride-containing group, —CHO, $—CONH_2$, $—SO_2NH_2$, and

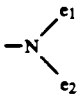

(wherein $e_1$ and $e_2$, which may be the same or different, each represents a hydrogen atom or a hydrocarbon group) at only one terminal of at least one polymer main chain thereof.

9. An electrophotographic light-sensitive material as claimed in claim 1, wherein the resin (A) and/or the resin (B) further contains a heat- and/or photo-curable functional group in the main chain thereof.

10. An electrophotographic light-sensitive material as claimed in claim 1, wherein a ratio of the resin (A)/the resin (B) is 5 to 80/95 to 20.

11. An electrophotographic light-sensitive material as claimed in claim 1, wherein the photoconductive layer further contains a spectral sensitizer.

12. An electrophotographic light-sensitive material as claimed in claim 11, wherein the spectral sensitizer is a polymethine dye capable of spectrally sensitizing in the wavelength region of 700 nm or more.

13. An electrophotographic light-sensitive material as claimed in claim 1, wherein the photoconductive layer further contains a chemical sensitizer.

* * * * *